US010141649B2

(12) United States Patent
Miura et al.

(10) Patent No.: US 10,141,649 B2
(45) Date of Patent: Nov. 27, 2018

(54) ANTENNA DEVICE AND MANUFACTURING METHOD OF ANTENNA DEVICE

(71) Applicant: SUMIDA CORPORATION, Chuo-Ku, Tokyo (JP)

(72) Inventors: Yoshinori Miura, Natori (JP); Hiroshi Kawasaki, Natori (JP); Takanobu Rokuka, Natori (JP); Kei Tanaka, Natori (JP); Shigeru Mahara, Natori (JP); Noriaki Iwasaki, Natori (JP); Shuichi Kikuchi, Natori (JP)

(73) Assignee: SUMIDA CORPORATION, Tokyo (JP)

( * ) Notice: Subject to any disclaimer, the term of this patent is extended or adjusted under 35 U.S.C. 154(b) by 92 days.

(21) Appl. No.: 15/260,814

(22) Filed: Sep. 9, 2016

(65) Prior Publication Data

US 2017/0104272 A1 Apr. 13, 2017

(30) Foreign Application Priority Data

Oct. 13, 2015 (JP) ..... 2015-202375

(51) Int. Cl.

| | |
|---|---|
| ***H01Q 1/00*** | (2006.01) |
| ***H01Q 7/08*** | (2006.01) |
| ***H01Q 1/36*** | (2006.01) |
| ***H01Q 1/32*** | (2006.01) |

(52) U.S. Cl.
CPC ..... *H01Q 7/08* (2013.01); *H01Q 1/3241* (2013.01); *H01Q 1/36* (2013.01)

(58) Field of Classification Search
CPC ..... H01Q 1/36; H01Q 7/08; H01Q 1/3241
See application file for complete search history.

(56) References Cited

U.S. PATENT DOCUMENTS

2011/0215987 A1* 9/2011 Ohara ..... H01Q 1/50 343/906

FOREIGN PATENT DOCUMENTS

| | | |
|---|---|---|
| JP | 2008181947 A | 8/2008 |
| JP | 2010081088 A | 4/2010 |

* cited by examiner

*Primary Examiner* — Dieu H Duong
(74) *Attorney, Agent, or Firm* — Cantor Colburn LLP

(57) ABSTRACT

An antenna device including: a core formed by magnetic material; a terminal attachment unit arranged on one end side of the core; a coil which is arranged on the outer circumferential side of the core and concurrently, which is formed by winding a conductive wire; a plurality of terminal members which are mounted on the terminal attachment unit and concurrently, each of which is electrically connected with a terminal of the conductive wire or an electronic component at any position thereof; a connector connecting unit provided with a connector hole into which an external connector is inserted; and a partition unit partitioning the terminal attachment unit and the connector connecting unit, wherein a terminal hole is provided at the partition unit, and at least two or more of the terminal members are plugged-in into the terminal hole and concurrently, are mounted in a state of protruding toward the connector hole.

19 Claims, 15 Drawing Sheets

ANTENNA DEVICE AND MANUFACTURING METHOD OF ANTENNA DEVICE

CROSS REFERENCES TO RELATED APPLICATIONS

The present invention contains subject matter related to Japanese Patent Application JP2015-202375 filed in the Japanese Patent Office on Oct. 13, 2015, the entire contents of which being incorporated herein by reference.

BACKGROUND OF THE INVENTION

Field of the Invention

The present invention relates to an antenna device and a manufacturing method of an antenna device.

Description of the Related Art

In recent years, the number of vehicles has been increasing in which there are mounted antenna devices for receiving signals for carrying out locking and unlocking of the doors thereof. For such antenna devices, there is, for example, an antenna disclosed in a Patent Document 1 (Japanese unexamined patent publication No. 2010-081088). The antenna device disclosed in the Patent Document 1 is configured such that it has a constitution in which a coil is wound around a bar-shaped magnetic core. In order to manufacture this antenna device, a plate obtained by forming a metal plate in a predetermined shape by pressing or the like is arranged inside a mold. After the arrangement thereof, there is employed an insert-molding for filling a filling-member such as a resin or the like. According to this insert-molding, the plate which will become a terminal and a resin base are formed integrally.

In addition, in the configuration disclosed in the Patent Document 1, there is formed a case covering the outer circumference of the aforesaid core by employing a mold-forming after winding a coil around the outer circumferential surface of a magnetic-body core.

In addition, in Patent Document 2 (Japanese unexamined patent publication No. 2008-181947), there is disclosed a constitution in which a coil is formed at a base of an antenna coil, a plate-shaped mother metal is made to protrude from the one-side surface of that base and an electronic component such as a chip capacitor or the like is to be mounted at the protruding portion of that plate-shaped mother metal. In this constitution, the base and the plate-shaped mother metal are formed by insert-molding. In addition, the electronic component is fixed by passing a reflow furnace after being coated with a cream solder.

SUMMARY OF THE INVENTION

Meanwhile, in case of employing the insert-molding as disclosed in the Patent Document 1, it is necessary to form the plate-shaped mother metal having a predetermined shape before that insert-molding. In case of forming this plate-shaped mother metal, it becomes a state in which a lot of portions will be cut off from the metal plate and in which a lot of portions becoming useless will be caused for the metal plate which is the material thereof. In addition, in order to form the plate-shaped mother metal having a predetermined shape, it also becomes necessary to use an exclusive press mold.

In addition, in case of employing the insert-molding by setting the plate-shaped mother metal in the inside of the mold for the injection-molding, it is necessary to fix the plate-shaped mother metal at a predetermined position in the inside of the mold. Further, for the portion within the plate-shaped mother metal, which is exposed from the injection-molding mold, it is necessary to take measures for blocking the filled resin in correspondence with that portion. For that reason, it becomes a state in which the mold becomes complicated and caused by this fact, it becomes a state in which also the cost thereof will increase.

In addition, in the configuration disclosed in the Patent Document 2, it is necessary to pass a reflow furnace on an occasion of the soldering and therefore, it is necessary, also with regard to the base, to provide a resin having a high heat-resistance which can endure the high temperature of the reflow furnace. However, in case of using such a resin, there is such a problem in which the cost thereof will increase.

The present invention was invented in view of this problem and is addressed to try to provide an antenna device and a manufacturing method of an antenna device in which it is possible to mount a terminal member easily without employing an insert-molding.

In addition, it is preferable for the present invention to be able to provide an antenna device and a manufacturing method of an antenna device in which it is possible to use a base having a low heat-resistance while employing a soldering of an electronic component in a reflow furnace.

One aspect of an antenna device of the present invention has a feature in which there are included: a core formed by a magnetic material; a terminal attachment unit arranged on one end side of the core; a coil which is arranged on the outer circumferential side of the core and concurrently, which is formed by winding a conductive wire; a plurality of terminal members which are mounted on the terminal attachment unit and concurrently, each of which is electrically connected with a terminal of the conductive wire or an electronic component at any position thereof; a connector connecting unit provided with a connector hole into which an external connector is inserted; and a flange unit which partitions the terminal attachment unit and the connector connecting unit, wherein at the flange unit, there is provided a terminal hole, and at the terminal attachment unit, there are provided at least two or more members of the terminal members which are plugged-in into the terminal hole and concurrently, are mounted in a state of protruding toward the connector hole.

Also, in addition to the above-mentioned invention, it is preferable for another aspect of an antenna device of the present invention to further employ a configuration in which the terminal member is provided with a chip-support-piece portion and a plug-in piece portion which is bent with respect to this chip-support-piece portion, the terminal attachment unit is provided with a pair of terminal concave portions which make the distal side of the chip-support-piece portion protrude while making the pair of terminal member enter thereinto, a pair of through-holes pass through the terminal attachment unit and the pair of through-holes are provided so as to be opened at arbitrary positions in the pair of terminal concave portions and also, is provided such that the plug-in piece portion will be plugged-in thereinto, the side facing the through-hole within the terminal concave portions is provided in a cut-out opened shape, and at the protruding portion on the distal side of the chip-support-piece portion, there is mounted the electronic component in an electrically conductive state.

Further, in addition to the above-mentioned invention, it is preferable for another aspect of an antenna device of the present invention to further employ a configuration in which the terminal attachment unit is provided with an opening portion which penetrates the aforesaid terminal attachment unit and concurrently, for the opening portion, at least two of the terminal members approach in a state of being spaced apart from each other, at the opening portion, the electronic component is arranged and also, is mounted in a state of being electrically conductive with the terminal members which approach the aforesaid opening portion.

Also, in addition to the above-mentioned invention, it is preferable for another aspect of an antenna device of the present invention to further employ a configuration in which at least one edge portion of the opening portion is provided with a peripheral wall unit which is formed to have a large thickness compared with other portions surrounding the aforesaid opening portion, and the terminal member is mounted on the terminal attachment unit by penetrating either one of the terminal hole and the peripheral wall unit.

Further, in addition to the above-mentioned invention, it is preferable for another aspect of an antenna device of the present invention to further employ a configuration in which at the terminal attachment unit, there is arranged an integrated terminal unit, the integrated terminal unit is provided with an attachment plate and the plurality of terminal members, the plurality of terminal members are fixed in a state of being spaced apart from each other by the attachment plate, the integrated terminal unit is provided with an opening portion, for the opening portion, at least two of the terminal members approach in a state of being spaced apart from each other, at the opening portion, the electronic component is arranged and also, is mounted in a state of being electrically conductive with the terminal members which approach the aforesaid opening portion.

According to the present invention, it becomes possible to mount the terminal member easily without employing an insert-molding.

DESCRIPTION OF THE PREFERRED EMBODIMENTS (First Exemplified Embodiment)

Hereinafter, there will be explained an antenna device 10A relating to a first exemplified embodiment of the present invention with reference to the drawings. It should be noted in the explanation hereinafter that there will be explained also a manufacturing method of the antenna device 10A appropriately during the explanation of the constitution thereof.

In addition, in the explanation hereinafter, there sometimes happens a case in which the explanation is carried out by using the XYZ rectangular coordinate system. Within the explanation thereof, the X direction is assumed to be a longitudinal direction of the antenna device 10A, in which the X1 side is assumed to be the side at which a connector connecting unit 45A mentioned later is positioned and the X2 side is assumed to be the side opposite thereto. In addition, the Z direction is assumed to be a thickness direction of the antenna device 10A, in which the Z1 side is assumed to be the upper side in FIG. 2 and the Z2 side is assumed to be the lower side in FIG. 2. In addition, the Y direction is assumed to be the direction orthogonal to the XZ directions (i.e. width direction), in which the Y1 side is assumed to be the right front side in FIG. 1 and the Y2 side is assumed to be the rear left side which is the side opposite thereto.

<With Regard to Whole Constitution of Antenna Device 10A>

Figure 1:
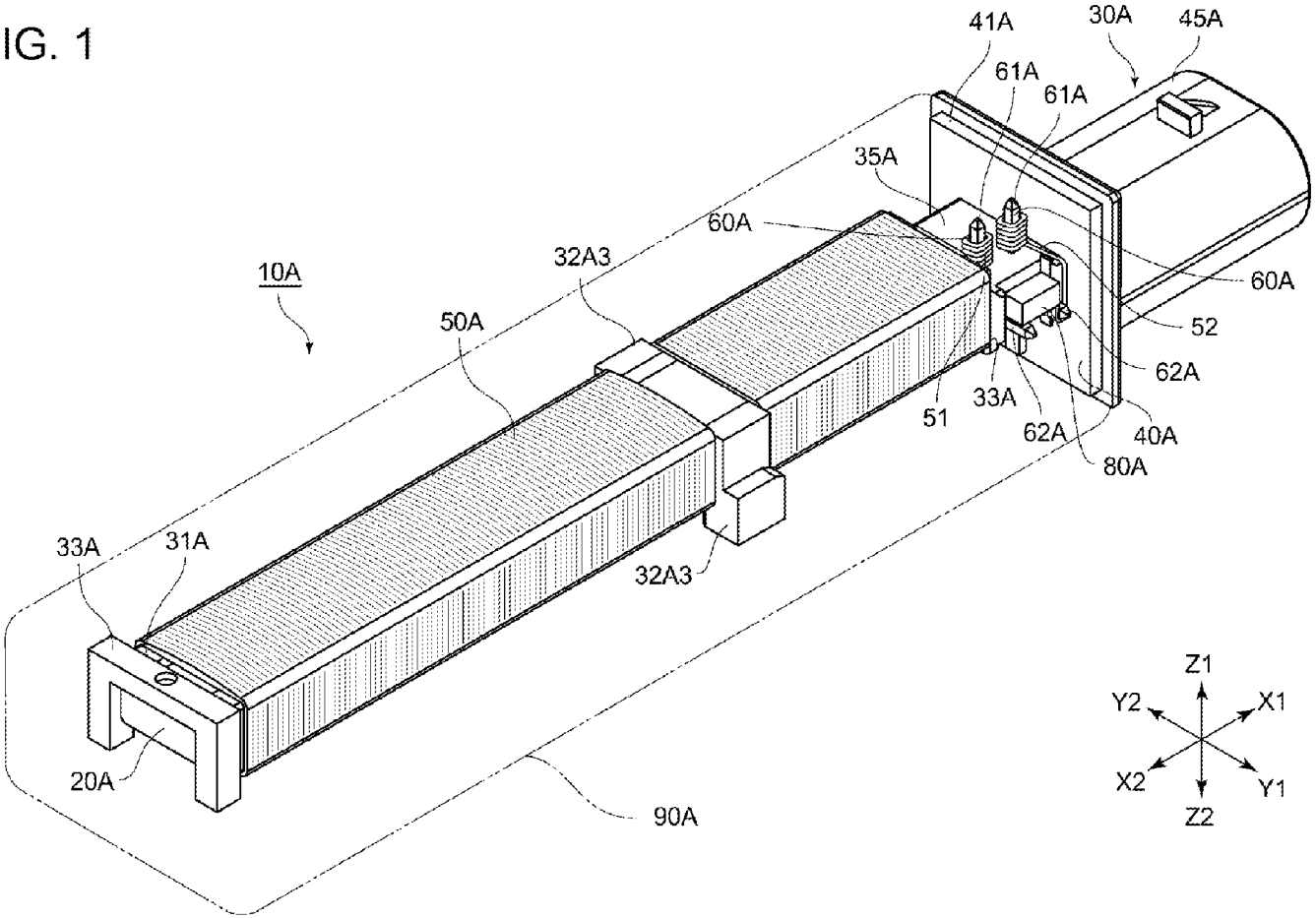
FIG. 1 is a perspective view showing a whole constitution of an antenna device relating to a first exemplified embodiment of the present invention.
Figure 2:
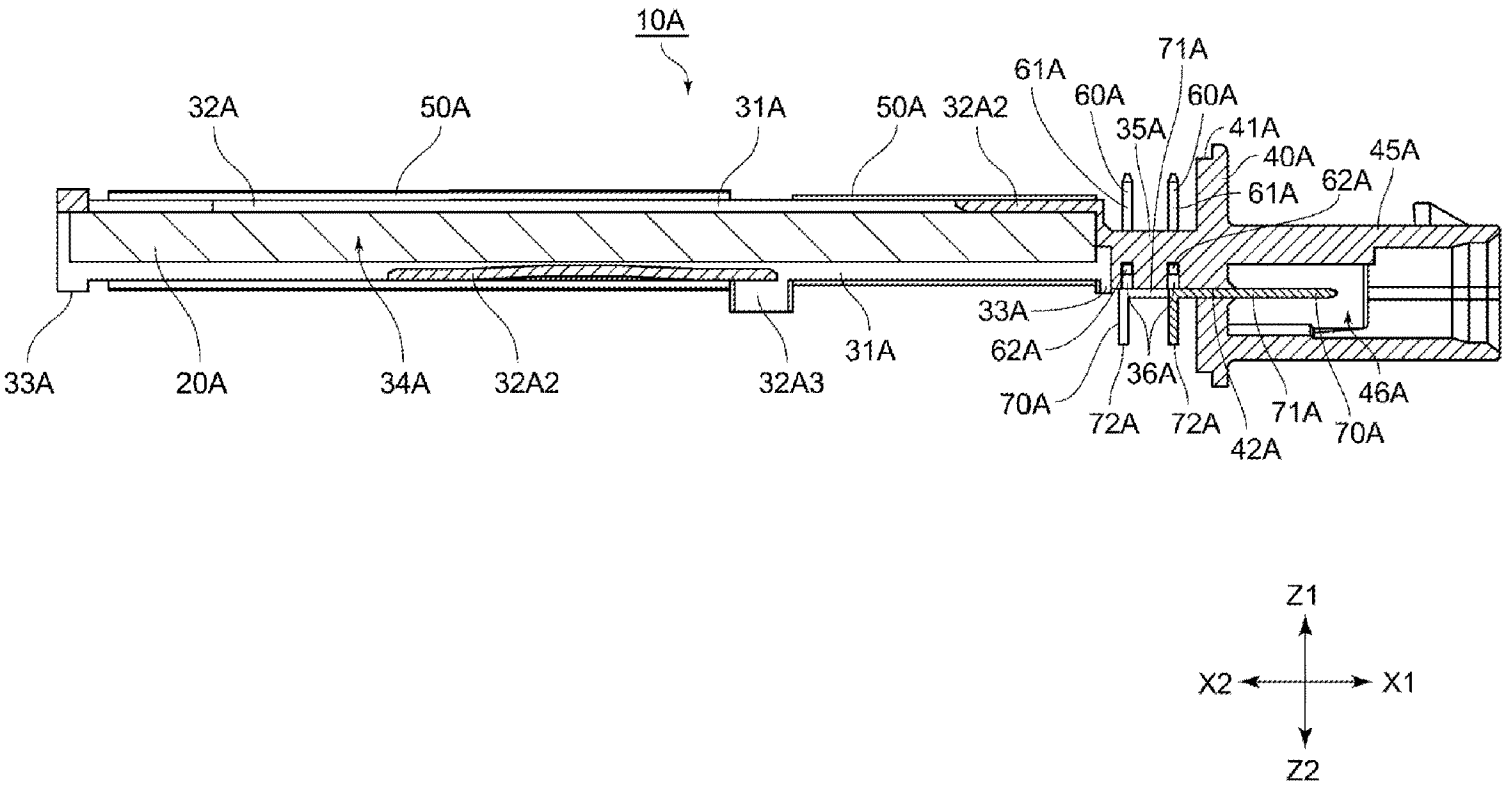
FIG. 2 is a cross-sectional side view showing a constitution of the antenna device in FIG. 1.

FIG. 1 is a perspective view showing a whole constitution of the antenna device 10A. FIG. 2 is a cross-sectional side view showing a constitution of the antenna device 10A. As shown in FIGS. 1 and 2, the antenna device 10A includes a core 20A, a base 30A, a coil 50A, a connection terminal 60A, a user terminal 70A and a case 90A as the main constituents thereof.

As shown in FIG. 2, the core 20A is formed by a magnetic material and concurrently, is provided in an elongated shape (bar shape) toward the X direction. In addition, the core 20A is formed to have a rectangular-shaped cross-section when viewed from the front. It should be noted for the core 20A that the material thereof is made to be a magnetic material, in which for the magnetic material, it is possible to use a variety of magnetic materials such as, for example, various kinds of ferrites such as nickel based ferrites or manganese based ferrites, permalloy, sendust and the like, and to use a variety of mixtures of magnetic materials.

In addition, as shown in FIG. 2, on the outer circumferential side of the core 20A, there is mounted the base 30A. In other words, the core 20A is inserted into a core insertion portion 34A of the base 30A. It is preferable for the material of the base 30A to employ a thermoplastic resin or thermosetting resin which has excellent insulation properties. It should be noted that for one example of the material which constitutes the base 30A, there can be cited PBT (polybutyleneterephthalate), but it is allowed to employ another resin for the material thereof. In addition, in view of the fact that there exists a case in which the base 30A may receive a heat damage caused by a soldering, a welding process and the like, it is more preferable to use a heat-resistant resin.

Figure 3:
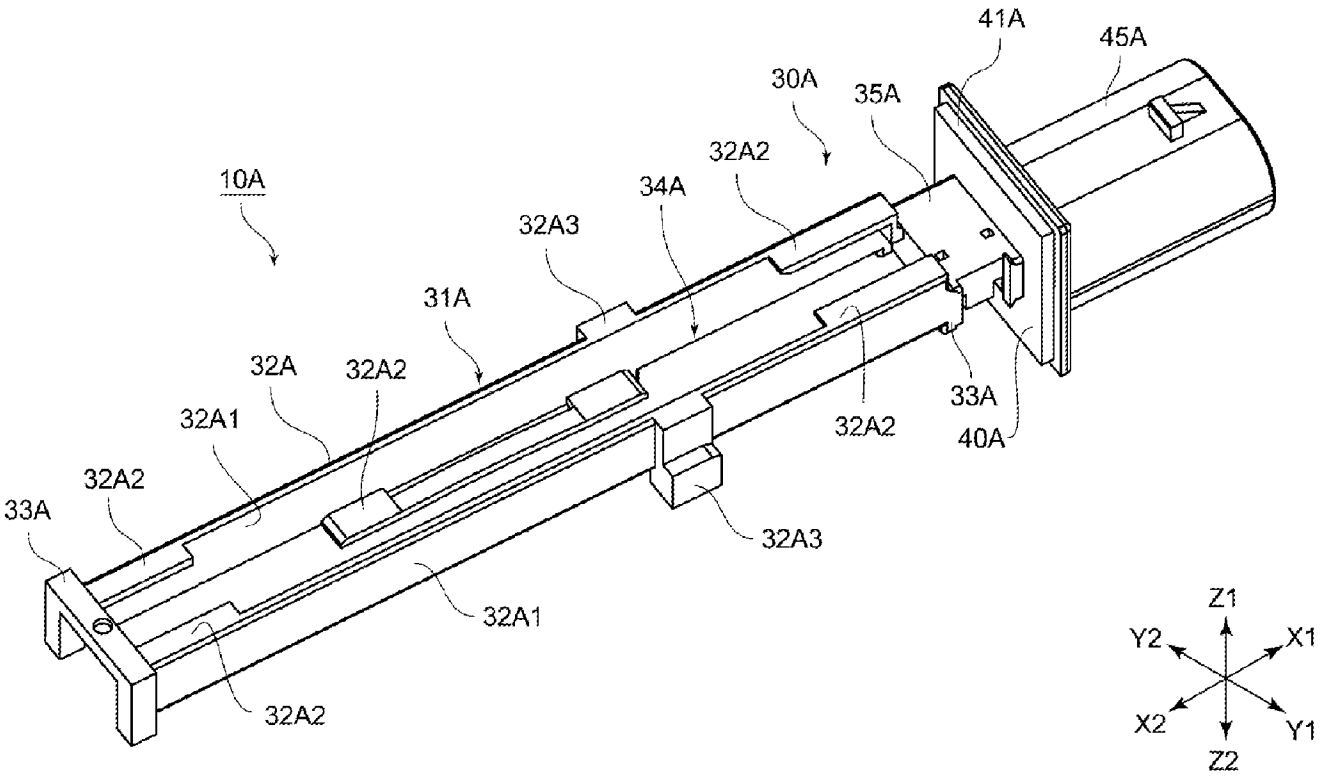
FIG. 3 is a perspective view showing a constitution of a base in the antenna device in FIG. 1.

FIG. 3 is a perspective view showing a constitution of the base 30A. As shown in FIG. 3, the base 30A is provided with a bobbin unit 31A, a terminal attachment unit 35A, a flange unit 40A and a connector connecting unit 45A. The bobbin unit 31A is provided with a winding-frame unit 32A and a positioning convex portion 33A. It is allowed for this winding-frame unit 32A to employ a cylindrical shape, but for this exemplified embodiment, the portion 32A is provided in a lightened shape eliminating the center body. Specifically, as shown in FIG. 3, the necessary strength is kept by providing flange portions 32A2 appropriately on the upper side (Z1 side) and the lower side (Z2 side) while maintaining side wall portions 32A1.

In addition, the positioning convex portions 33A are provided on the both end sides of the winding-frame unit 32A and are the portions which protrude from the winding-frame unit 32A. In this exemplified embodiment, the positioning convex portion 33A which is positioned on one end side (X1 side) of the winding-frame unit 32A in the longitudinal direction (X direction) is provided so as to further protrude toward the lower side from the lower side (Z2 side) of the winding-frame unit 32A. In addition, the positioning convex portion 33A which is positioned on the other end side (X2 side) of the winding-frame unit 32A in the longitudinal direction (X direction) is provided so as to protrude from the up, down, right and left sides of the winding-frame unit 32A.

In addition, the bobbin unit 31A is provided also with a separation unit 32A3. The separation unit 32A3 is a unit which separates the coil 50A and prevents the winding irregularity thereof when forming the elongated coil 50A. It should be noted that it is possible to provide the separation unit 32A3 at an arbitrary position in the midway in the longitudinal direction (X direction) of the bobbin unit 31A.

In addition, on one side (X1 side) of the base 30A, there is provided the terminal attachment unit 35A in a state of being continuous therewith. The terminal attachment unit 35A is a unit formed by (solidly) filling a resin and therefore, this terminal attachment unit 35A is formed in a state in which there exists no core 20A in the inside thereof.

Figure 4:
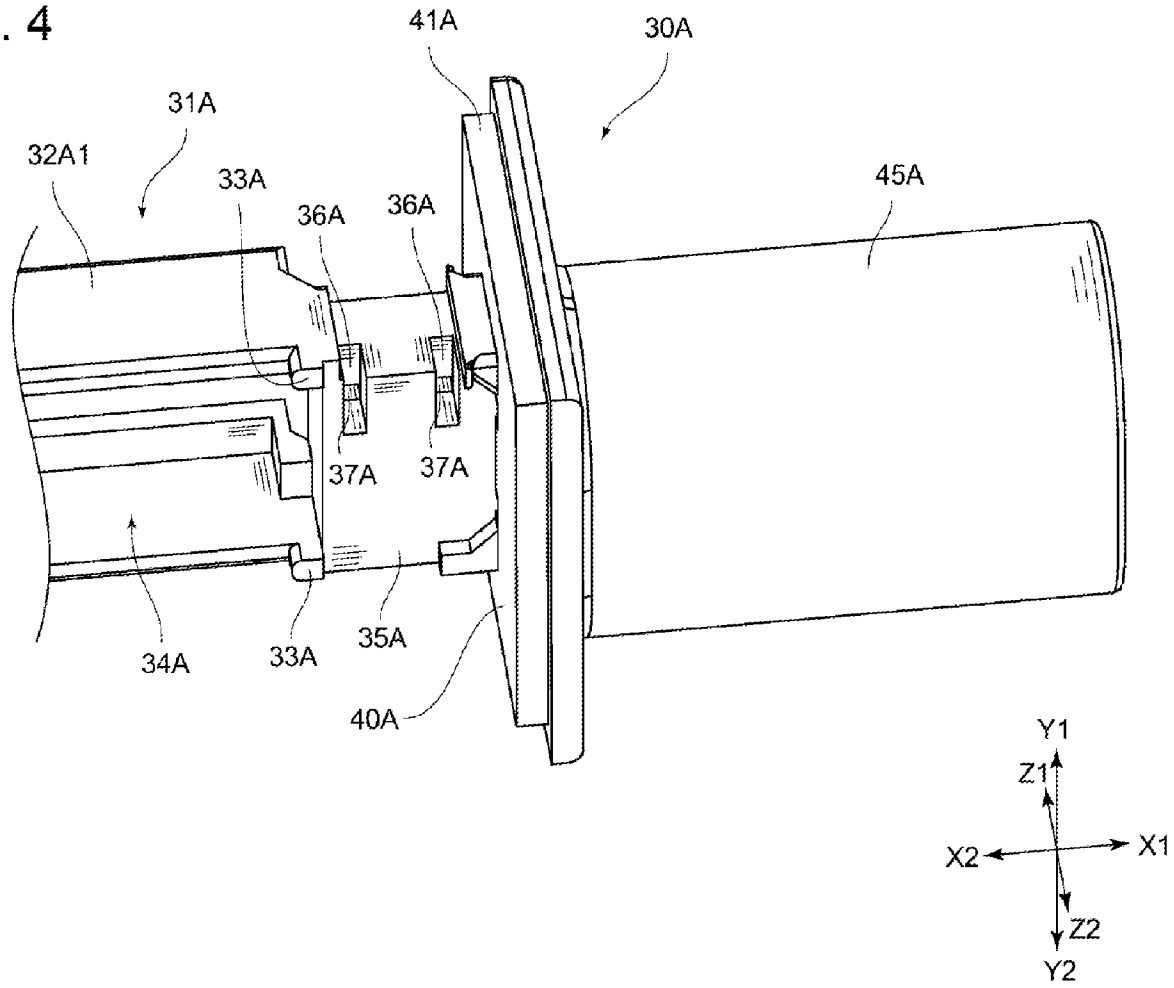
FIG. 4 is a perspective view showing a constitution seeing a terminal attachment unit of the antenna device in FIG. 1 from the lower side thereof.

FIG. 4 is a perspective view showing a constitution seeing the terminal attachment unit 35A from the lower side (Z2 side) thereof. As shown in FIG. 4, the terminal attachment unit 35A is provided with a pair of terminal concave portions 36A. Each of the terminal concave portions 36A is a portion which is obtained by being cut-out as much as a predetermined size so as to be directed from one side (Y1 side) in the width direction (Y direction) to the other side (Y2 side) of the terminal attachment unit 35A and also, so as to be directed from the lower side (Z2 side) to the upper side (Z1 side) thereof. In addition, there is provided a through-hole 37A so as to be directed from the upper bottom surface on the rear side (Y2 side) of the terminal concave portion 36A to the upper surface of the terminal attachment unit 35A. It is preferable for this through-hole 37A to be provided in flush with the wall surface on the rear side (Y2 side) of the terminal concave portion 36A, but it is allowed to be provided not in flush therewith.

Into each of the through-holes 37A, a plug-in piece portion 61A (mentioned later) of the connection terminal 60A will be plugged-in, in which a chip-support-piece portion 62A (mentioned later) within that connection terminal 60A is positioned at the terminal concave portion 36A. Furthermore, the distal side (Y1 side) of each chip-support-piece portion 62A is provided so as to protrude toward the front side (Y1 side) from the terminal concave portion 36A. Then, at the protruding portions of a pair of chip-support-piece portions 62A, there is mounted a capacitor 80A which corresponds to the electronic component.

In addition, at the boundary portion on one side (X1 side) in the longitudinal direction (X direction) of the terminal attachment unit 35A, there is provided the flange unit 40A which corresponds to the partition unit. According to the constitution shown in FIG. 1 or FIG. 3, the flange unit 40A is formed as a unit which is provided in a plate shape having a predetermined thickness. This flange unit 40A is a unit for fitting the case 90A and for the fitting thereof, there is included a step portion 41A which is recessed by one step in which the outer circumferential side thereof is directed from the other end side (X2 side) toward the one end side (X1 side).

In addition, as shown in FIG. 2, the flange unit 40A is provided with a terminal hole 42A and into this terminal hole 42A, there will be plugged-in the user terminal 70A which is connected with an external electric circuit (as mentioned later). The terminal hole 42A is provided so as to go along the longitudinal direction (X direction) and therefore, it is made possible for the user terminal 70A, which is pushed into the terminal hole 42A from the other side (X2 side), to protrude toward an after-mentioned connector hole 46A. It should be noted in this exemplified embodiment that the user terminal 70A is provided as a pair of terminals, so that also the terminal hole 42A exists as a pair of holes. However, it is possible to change the number of the terminal holes 42A appropriately corresponding to the number of the user terminals 70A.

It should be noted that it is allowed to employ a configuration in which the terminal hole 42A is to be formed separately from the user terminal 70A and after the formation thereof, the user terminal 70A is to be plugged-in thereinto. In addition, on the contrary, in order to secure the mounting strength of the user terminal 70A, it is allowed to employ a configuration in which the user terminal 70A is placed in the inside of a mold and thereafter, the formation thereof is completed depending on an insert-molding by such a way of injecting a resin therein.

In addition, there is provided the connector connecting unit 45A on one side (X1 side) at a farer position than that of the flange unit 40A in the longitudinal direction (X direction). The connector connecting unit 45A includes the connector hole 46A and there is employed a configuration in which the other end side (X2 side) of that connector hole 46A is formed to be bottomed caused by the existence of the above-mentioned flange unit 40A. In addition, the distal side of the user terminal 70A protrudes in the inside of the connector hole 46A. Then, there is employed such a configuration that when plugging-in an external connector into the connector hole 46A, the external connector and the user terminal 70A are connected electrically in which it is possible to conduct an electric current through a coil 50A or a capacitor 80A which will be mentioned later.

As shown in FIGS. 1 and 2, on the outer circumferential side of the winding-frame unit 32A, there is formed the coil 50A by winding a conductive wire 51 therearound. In this exemplified embodiment, one terminal of the conductive wire 51 which forms the coil 50A is fixed by a soldering or the like after being bound on the distal side of the plug-in piece portion 61A of the other connection terminal 60A (60A2). In addition, the other terminal of the conductive wire 51 which forms the coil 50A is bound on the lower-side protruding portion 72A of the other user terminal 70A (user terminal 70A2). It should be noted that for the distal side of the plug-in piece portion 61A of one connection terminal 60A (60A1) and the lower-side protruding portion 72A of one user terminal 70A (70A1), an LC resonant circuit is constituted by being fixed by a soldering or the like after a connection wire for electrically-connecting those above is bound therearound.

Figure 5:
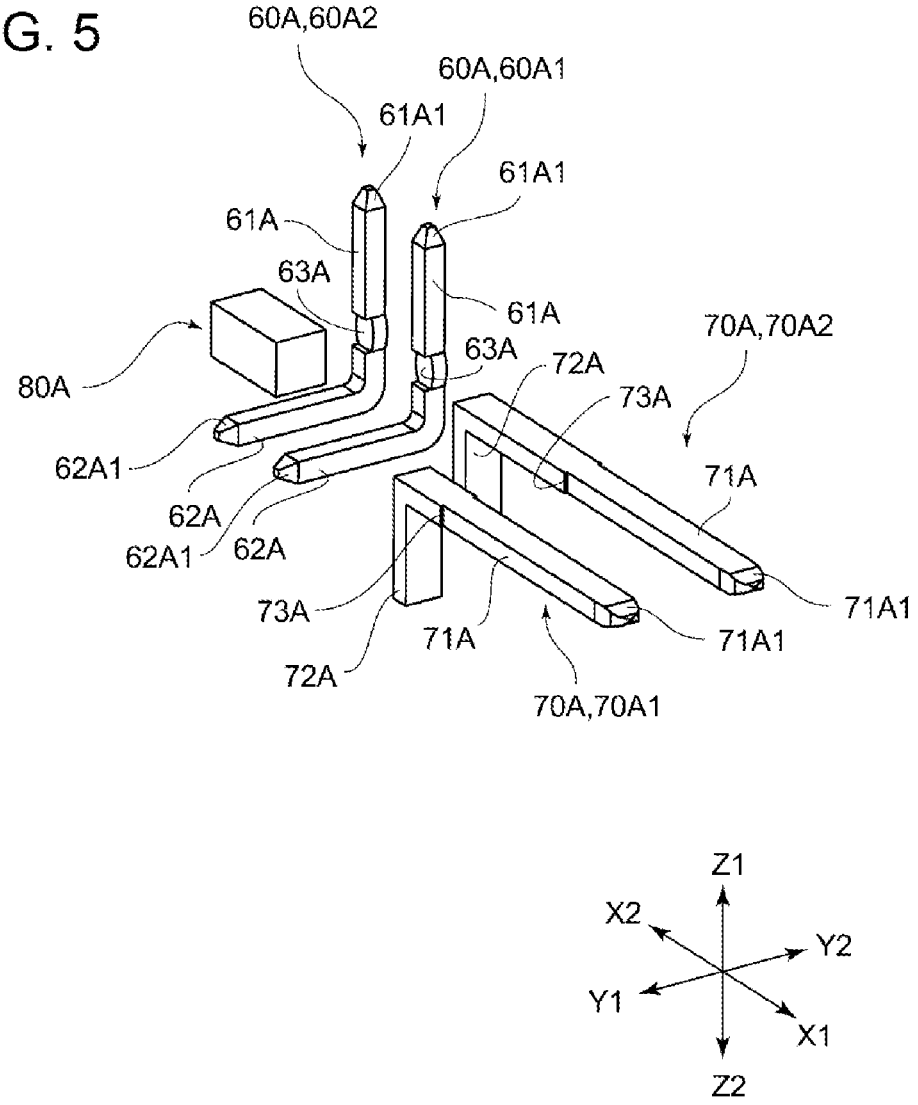
FIG. 5 is a perspective view showing a constitution of a terminal member and a user terminal of the antenna device in FIG. 1.

Next, there will be explained the connection terminal 60A and the user terminal 70A. It should be noted that both of the connection terminal 60A and the user terminal 70A correspond to the terminal members. FIG. 5 is a perspective view showing a constitution of the connection terminal 60A and the user terminal 70A. It should be noted in FIG. 5 that there is shown also the capacitor 80A. As shown in FIG. 5, the connection terminals 60A of this exemplified embodiment are members formed in substantially L-shapes by employing a press-molding with respect to metal-made terminals. It should be noted in this exemplified embodiment that in a case in which it is necessary to distinguish the pair of connection terminals 60A, the connection terminal 60A on one side (X1 side) in the longitudinal direction (X direction) of the antenna device 10A is to be referred to as the connection terminal 60A1 and the connection terminal 60A on the other side (X2 side) is to be referred to as the connection terminal 60A2.

The connection terminal 60A is provided such that the outward appearance thereof forms a substantially L-shape. In order to form this substantially L-shape, the connection terminal 60A is bent so as to form a substantially-right angle at the midway portion thereof. It should be noted within the connection terminal 60A that the portion extending toward the up and down direction (Z direction) is to be referred to as the plug-in piece portion 61A and the portion extending toward the width direction (Y direction) is to be referred to as the chip-support-piece portion 62A. In addition, there is provided a wide-width portion 63A at a portion near the bent position within the plug-in piece portion 61A. The wide-width portion 63A is a portion which is formed to be wider than other portions of the plug-in piece portion 61A by the pressing on an occasion of the pressing process and is provided so as to have a width which becomes a little bit wider than the inner diameter of the through-hole 37A. Therefore, there is employed a constitution in which when pushing the plug-in piece portion 61A into the through-hole 37A, it is difficult for the plug-in piece portion 61A to drop out from the through-hole 37A.

Here, there is provided a tip-shaped portion 61A1 on the distal side (upper-end side: Z1 side) of the plug-in piece portion 61A. The tip-shaped portion 61A1 is formed to be a portion having a tip shape in which the cross-sectional area thereof becomes gradually small as going toward the upper side (Z1 side). Owing to the existence of this tip-shaped portion 61A1, it is possible to heighten the guidability when plugging-in the plug-in piece portion 61A into the through-hole 37A.

It should be noted that it is also allowed to employ a configuration in which the width of the plug-in piece portion 61A other than the wide-width portion 63A is formed to be a little bit wider than the width of the through-hole 37A. In case of employing such a constitution, it becomes more difficult for the plug-in piece portion 61A, which is plugged-in the through-hole 37A, to drop out.

In addition, the above-mentioned connection terminal 60A is an element, for example, which has a predetermined diameter and which is formed by a metal material having a cross-sectional shape of a circular, oval or polygonal shape, having an excellent conductivity such as copper (Cu), iron (Fe), nickel (Ni), an alloy thereof or the like, and furthermore, having a predetermined hardness, in which this element is shearing-processed to have a predetermined length. It should be noted that it is preferable for the surface of the connection terminal 60A to form a plated layer thereon by a metal material such as tin, nickel, cobalt, chromium, palladium, gold, copper or by an alloy material including those metal materials as the main component thereof.

It should be noted that it is preferable for the connection terminal 60A to have a cross-sectional shape of a substantially-rectangular shape with long sides and short sides when seeing from the viewpoint of being processed or being mounted. In addition, in FIG. 5 or the like, there is shown a case in which two connection terminals 60A are provided. However, it is allowed to employ a case in which any number (for example, three or four) of connection terminals 60A are provided.

In addition, with regard to at least one connection terminal 60A within the plurality of connection terminals 60A, the portion, within any one of the plug-in piece portions 61A, which protrudes toward the upper side (Z1 side) from the through-hole 37A become a portion around which the terminal of the conductive wire 51 forming the coil 50A will be bound. Furthermore, it is preferable for that binding portion to protrude toward the upper side (Z1 side) from the coil 50A for the sake of convenience of carrying out the soldering or the like by a dip method. In addition, each of the chip-support-piece portions 62A protrudes toward the front side (Y1 side) from the terminal concave portion 36A and is mounted in a state in which the capacitor 80A is connected electrically to that protruding portion. It should be noted that there is provided a tip-shaped portion 62A1 having a tip shape similar as that of the above-mentioned tip-shaped portion 61A1 also on the distal side (Y1 side) of the chip-support-piece portion 62A and the portion 62A1 is provided such that the cross-sectional area thereof becomes gradually small as going toward the distal side thereof.

In addition, also the user terminal 70A is provided such that the outward appearance thereof forms a substantially L-shape similarly as the connection terminal 60A by being bent so as to form a substantially-right angle at the midway portion thereof. It should be noted in this exemplified embodiment that in a case in which it is necessary to distinguish the pair of user terminals 70A, the user terminal 70A on the front side (Y1 side) in the width direction (Y direction) of the antenna device 10A is to be referred to as the user terminal 70A1 and the user terminal 70A on the rear side (Y2 side) is to be referred to as the user terminal 70A2. In addition, hereinafter, the portion extending toward the longitudinal direction (X direction) within this user terminal 70A is to be referred to as the connection terminal portion 71A and the portion extending toward the up and down direction (Z direction) is to be referred to as the lower-side protruding portion 72A. There is provided a portion 71A1 having a tip shape similar as that of the above-mentioned tip-shaped portion 61A1 also on the distal side (X1 side) of the connection terminal portion 71A and the portion 71A1 is provided such that the cross-sectional area thereof becomes gradually small as going toward the distal side thereof.

As shown in FIG. 5, there is provided a stair portion 73A at the connection terminal portion 71A. The stair portion 73A is formed by a configuration in which the width of the connection terminal portion 71A is made to be different. Specifically, for the lower-side protruding portion 72A side (X2 side) within the connection terminal portion 71A, the width thereof is provided to be wider than that of the distal side (X1 side) and caused by this configuration, the stair portion 73A is formed. This stair portion 73A is provided to be wider than the terminal hole 42A. Therefore, there is employed a constitution in which when plugging-in the connection terminal portion 71A into the terminal hole 42A, it is difficult for that connection terminal portion 71A to drop out from the terminal hole 42A.

It should be noted in this exemplified embodiment that the capacitor 80A is a chip capacitor of an SMD (Surface Mount Device) type, but it is allowed to employ another type of capacitor. This capacitor 80A is installed at the chip-support-piece portions 62A on the lower surface side (Z2 side) thereof and is fixed by a soldering or the like in a state of being electrically conductive.

In addition, the antenna device 10A is provided with a case 90A and an adhesion portion other than those above. The case 90A is provided in such a cylindrical shape as covering the coil 50A mentioned above and is provided such that one end side (X1 side) of that case 90A is opened. Then, that opening portion is fitted with the step portion 41A of the flange unit 40A. In addition, the adhesion portion is a portion for bonding the opening side of the case 90A onto the step portion 41A.

<With Regard to Manufacturing Method of Antenna Device 10A>

In case of manufacturing an antenna device 10A having a constitution such as described above, the base 30A is formed by an injection-molding. In addition, after forming the base 30A, the connection terminals 60A are to be positioned at the terminal concave portions 36A and at that time, there is established a state in which by pushing the plug-in piece portions 61A into the through-holes 37A, the upper sides (Z1 sides) of the plug-in piece portions 61A protrude from the upper surface side of the terminal attachment unit 35A (this process corresponds to the terminal member mounting process). At that time, there is obtained a state in which the chip-support-piece portions 62A protrude from the terminal concave portions 36A toward the front side (Y1 side). Thereafter, by pushing the connection terminal portions 71A of the user terminals 70A into the terminal holes 42A, the user terminals 70A are mounted onto the flange unit 40A (this process corresponds to the terminal member mounting process). At that time, there is obtained a state in which the distal sides of the connection terminal portions 71A protrude in the inside of the connector hole 46A of the connector connecting unit 45A.

Before or after carrying out that mounting above, the core 20A is mounted on the core insertion portion 34A. After that mounting, the conductive wire 51 is wound around the winding-frame unit 32A, in which caused by the winding force of the conductive wire 51, the side wall portion 32A1 and the flange portion 32A2 of the opened bobbin unit 31A are tightened, and the coil 50A is formed so as to fix the core 20A (this process corresponds to the coil formation process). Then, after the formation of the coil 50A, one terminal of the conductive wire 51 is bound on the distal side of the plug-in piece portion 61A of the other connection terminal 60A2. In addition, the other terminal of the conductive wire 51 is to be bound around the lower-side protruding portion 72A of the other user terminal 70A2. After those bindings, the above-mentioned binding portions are fixed, for example, by a soldering or the like depending on a dip method. In addition, before or after the mounting of the terminals of this conductive wire 51, the connection wire 52 are bound on the distal side of the plug-in piece portion 61A of the one connection terminal 60A1 and around the lower-side protruding portion 72A of the one user terminal 70A1, and after the bindings thereof, also those binding portions are fixed, for example, by a soldering or the like depending on a dip method similarly as mentioned above.

In addition, before or after the terminals of the conductive wire 51 are fixed, the capacitor 80A is mounted on the chip-support-piece portions 62A of the connection terminal 60A. In case of mounting the capacitor 80A on the chip-support-piece portions 62A, it is possible to utilize a method of, for example, coating a cream solder and thereafter heating that coated portion, but it is also allowed to carry out the mounting by another method of such as, for example, laser welding or the like.

After those processes, an adhesive agent is coated at the case 90A or at the step portion 41A and thereafter, the adhesion thereof is carried out by fitting the case 90A with step portion 41A. In this manner as described above, the antenna device 10A is to be formed.

<With Regard to Effect>

According to the antenna device 10A having the constitution as described above, there is provided a flange unit 40A between the terminal attachment unit 35A and the connector connecting unit 45A for partitioning them. In addition, the flange unit 40A is provided with the terminal hole 42A, and the terminal attachment unit 35A is mounted with the user terminal 70A through the flange unit 40A in a state of being pushed into the terminal hole 42A and also being protruded toward the connector hole 46A. For that reason, it is possible for the user terminal 70A to lie in a state of being positioned at the terminal attachment unit 35A by being pushed into the terminal hole 42A. Therefore, it becomes possible to mount the user terminal 70A easily without employing an insert-molding. For that reason, it becomes needless to use a mold for carrying out the insert-molding and it is possible to simplify the processing flow. In addition, it becomes needless to employ an insert-molding and therefore, it becomes possible to reduce the cost.

In addition, in the present exemplified embodiment,the connection terminal 60A is provided with the plug-in piece portion 61A and the chip-support-piece portion 62A. In addition, the chip-support-piece portion 62A is bent with respect to plug-in piece portion 61A. In addition, the terminal attachment unit 35A is provided with the terminal concave portion 36A which make the distal side of the chip-support-piece portion 62A protrude while making the connection terminal 60A enter thereinto, and at the protruding distal portion of that chip-support-piece portion 62A, there is mounted the capacitor 80A in an electrically conductive state. Further, the side facing the through-hole 37A within the terminal concave portion 36A is provided in a cut-out opening shape.

Therefore, when mounting the connection terminal 60A onto the terminal concave portion 36A in a state of invading thereinto, it becomes possible to mount the capacitor 80A on the distal side of the chip-support-piece portion 62A. More specifically, it is possible for chip-support-piece portion 62A to protrude toward the side direction of the terminal attachment unit 35A, in which it is possible to mount the capacitor 80A at that protruding position. For this reason, it becomes needless to employ an insert-molding when mounting the connection terminal 60A and therefore, it is possible to reduce the cost.

In addition, the through-holes 37A are provided so as to be opened at the terminal concave portions 36A and also, the plug-in piece portions 61A are provided so as to be plugged thereinto. For that reason, it is possible for the distal sides of the plug-in piece portions 61A to protrude toward the upper surface side of the terminal attachment unit 35A. Thus, it becomes possible to bind the terminal of the conductive wire 51 and the connection wire 52 at the position which protrudes toward the upper surface side of the terminal attachment unit 35A and it is possible to improve the workability.

(Second Exemplified Embodiment)

Hereinafter, there will be explained an antenna device 10B relating to a second exemplified embodiment of the present invention with reference to the drawings. It should be noted in this exemplified embodiment that although there will be omitted the explanation with regard to the common constitutions with those of the antenna device 10A in the first exemplified embodiment mentioned above, it is assumed that Alphabet "B" will be put at the ends of the reference numerals thereof instead of Alphabet "A" relating to the corresponding elements in the first exemplified embodiment. It should be noted that the Alphabet "B" means a constitution relating to the second exemplified embodiment. Therefore, although there will be eliminated the explanations or the like in the second exemplified embodiment, it is assumed, also with regard to similar constitutions as those of the antenna device 10A in the first exemplified embodiment, that there is a case in which the explanation will be carried out by putting the Alphabet "B".

Figure 6:
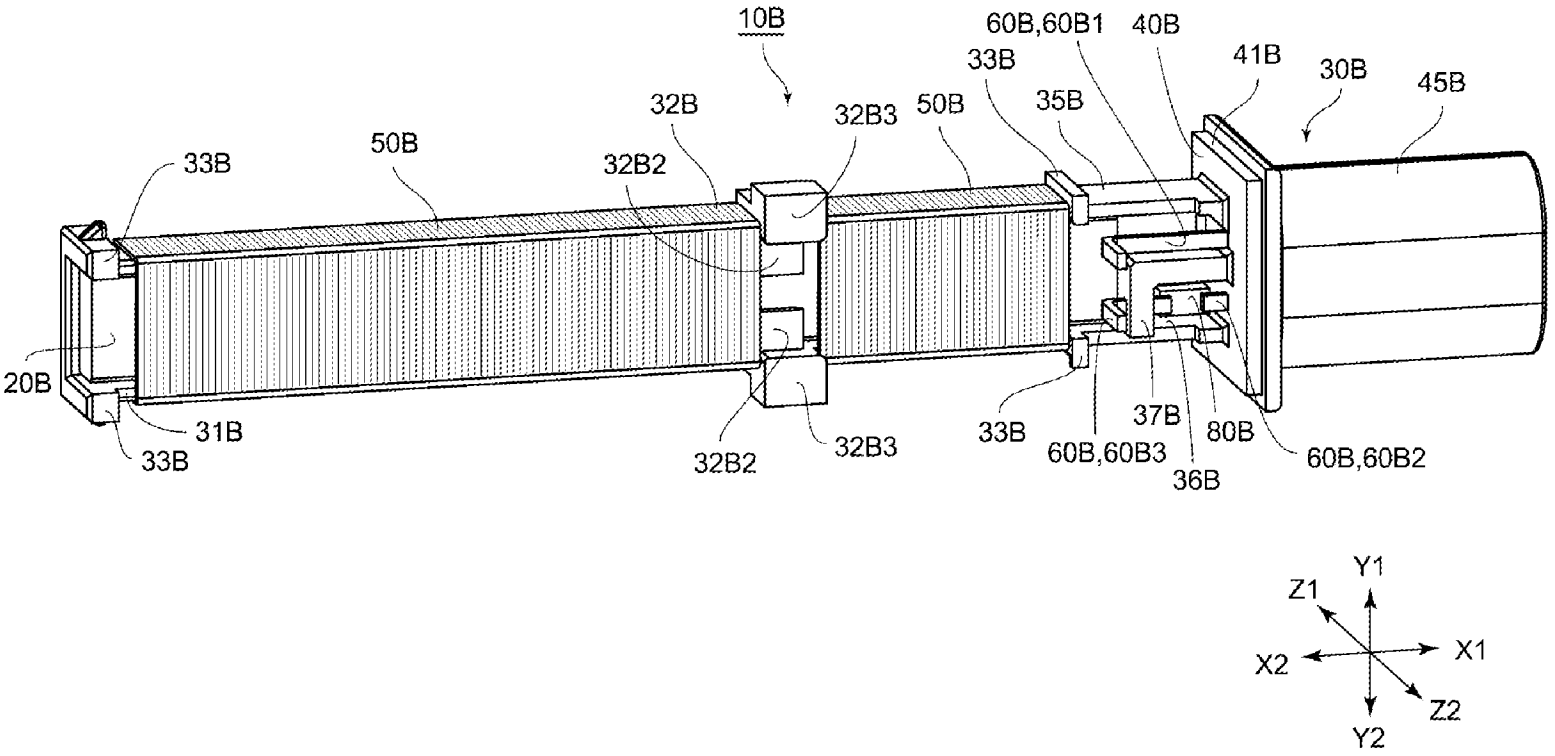
FIG. 6 is a perspective view showing a constitution of an antenna device relating to a second exemplified embodiment of the present invention and is a view showing a state seen from the lower surface side thereof.
Figure 7:
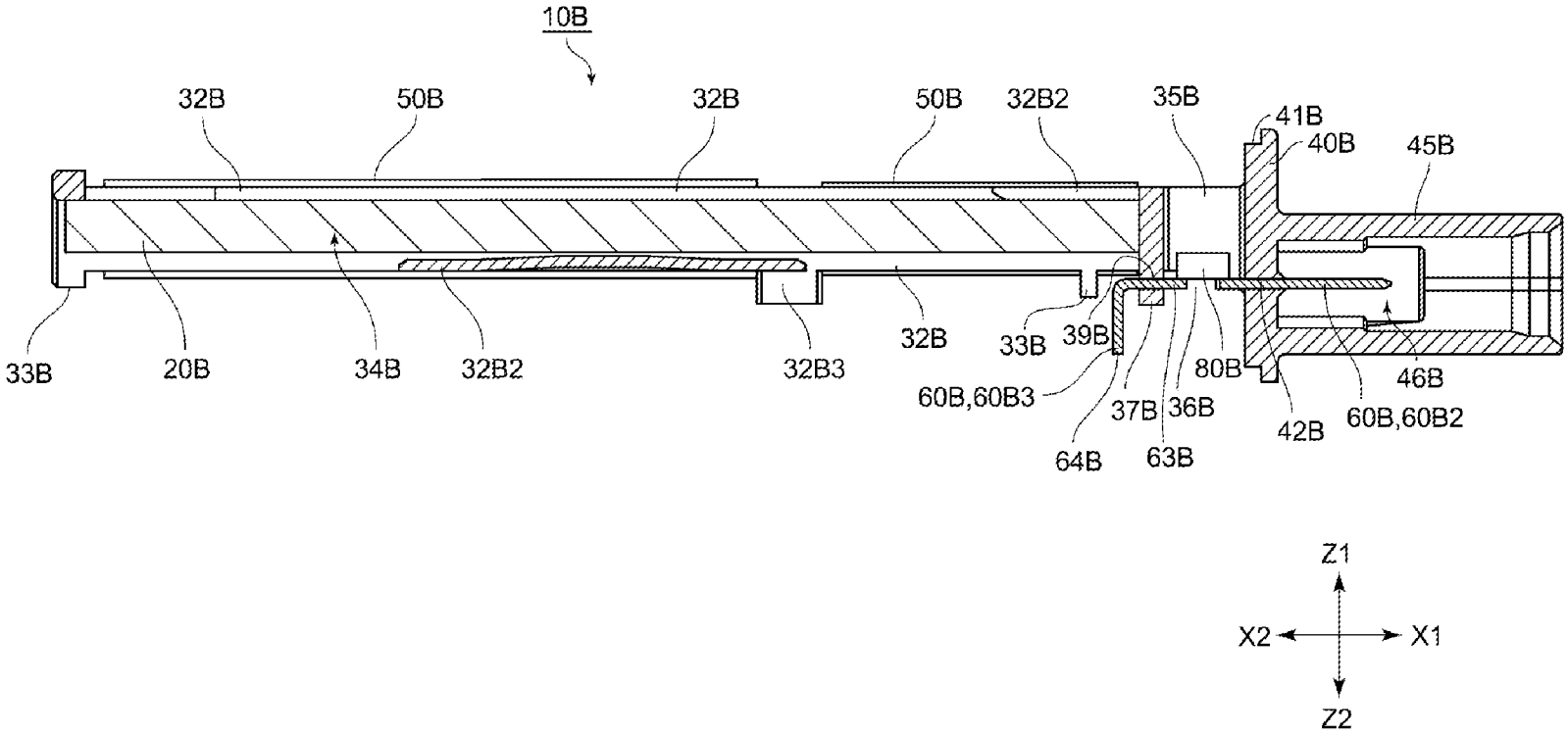
FIG. 7 is a cross-sectional side view showing a constitution of the antenna device in FIG. 6.
Figure 8:
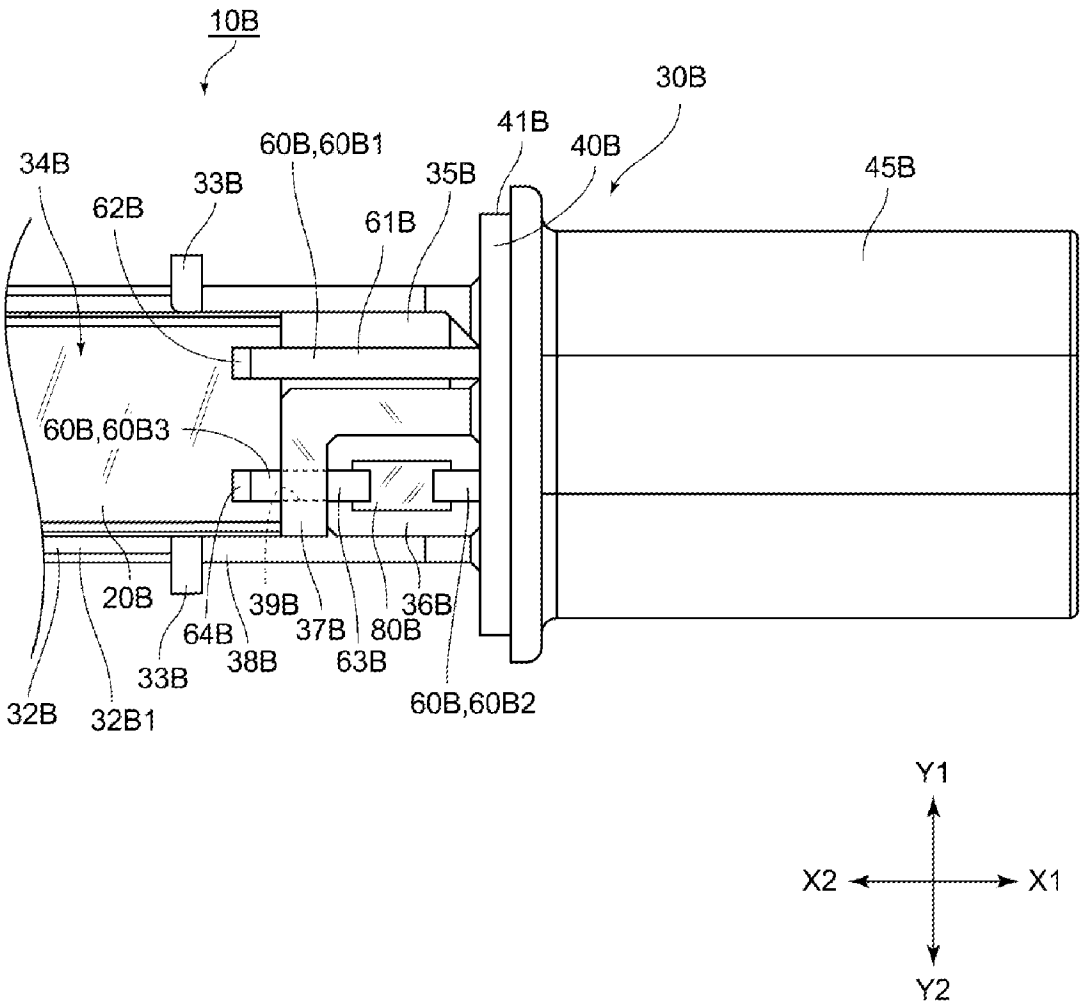
FIG. 8 is a view showing a constitution in the vicinity of the terminal attachment unit of the antenna device in FIG. 6 by being enlarged and is a bottom view showing a state seen from the lower surface side of the terminal attachment unit.

FIG. 6 is a perspective view showing a constitution of the antenna device 10B relating to the second exemplified embodiment and is a view showing a state seen from the lower surface side (Z2 side) thereof. FIG. 7 is a cross-sectional side view showing a constitution of the antenna device 10B. FIG. 8 is a view showing a constitution in the vicinity of the terminal attachment unit 35B by being enlarged and is a bottom view showing a state seen from the lower surface side of the terminal attachment unit 35B. For the antenna device 10B of this exemplified embodiment, there is provided the terminal attachment unit 35B which is different from the terminal attachment unit 35A of the antenna device 10A in the above-mentioned first exemplified embodiment. Hereinafter, there will be explained the detail thereof.

In this exemplified embodiment, the terminal attachment unit 35B is provided with an opening portion 36B which penetrates in the up and down direction (Z direction). As shown in FIG. 6 and FIG. 8, the area of this opening portion 36B is provided to be slightly larger by one-size compared with the area of the capacitor 80A when viewed planarly. It should be noted in this exemplified embodiment that the opening portion 36B is provided in a rectangular shape which is long in the longitudinal direction (X direction) of the antenna device 10B. In addition, there is provided a peripheral wall unit 37B so as to partition the opening portion 36B. The peripheral wall unit 37B is provided in a substantially L-shape, in which other portions surrounding the opening portion 36B are composed of an extended portion 38B formed by extending the side wall portion 32B1 of the winding-frame unit 32B toward one side (X1 side) of the longitudinal direction (X direction) and are composed of a flange unit 40B.

Here, the peripheral wall unit 37B is provided so as to protrude toward the lower side (Z2 side) from the extended portion 38B. In addition, the peripheral wall unit 37B is provided with a through-hole 39B going along the longitudinal direction (X direction) and a terminal member 60B3 mentioned later will be plugged-in into that through-hole 39B. Therefore, in order to improve the function for supporting the terminal member 60B3, the thickness of the peripheral wall unit 37B is provided so as to become thicker than the thickness of the extended portion 38B. In addition, by providing the thickness of the peripheral wall unit 37B to be thicker than the thickness of the extended portion 38B, it is possible to improve the heat-resistance of this peripheral wall unit 37B. Therefore, even if the cream solder which is coated onto the terminal member 60B2 and the terminal member 60B3 is melted, it is possible to provide a constitution which can endure that heat.

Figure 9:
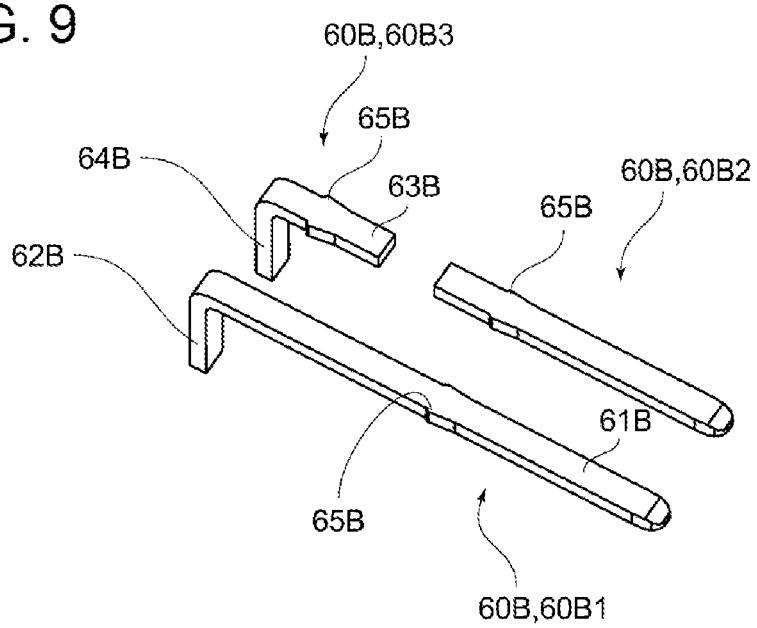
FIG. 9 is a plan view showing shapes of three terminal members in the antenna device in FIG. 6.
Figure 9:
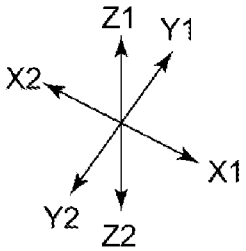

In addition, as shown in FIG. 8, there are provided three of terminal members 60B in this exemplified embodiment. More specifically, there exist the terminal members 60B1, 60B2 and 60B3. FIG. 9 is a plan view showing shapes of the three terminal members 60B1, 60B2 and 60B3. As shown in FIGS. 8 and 9, the terminal member 60B1 within the three terminal members 60B is a terminal member 60B1 which is positioned on the front side (Y1 side) in the width direction (Y direction). In addition, the terminal member 60B2 is positioned on one side (X1 side) in the longitudinal direction (X direction) while being positioned on the rear side (Y2 side) in the width direction (Y direction). Further, the terminal member 60B3 is positioned on the other side (X1 side) in the longitudinal direction (X direction) while being positioned on the rear side (Y2 side) in the width direction (Y direction).

Here, the terminal member 60B1 is used in common for both the functions of the connection terminal 60A and the user terminal 70A in the above-mentioned first exemplified embodiment. Therefore, the terminal member 60B1 is provided to be the longest among the three terminal members 60B. Specifically, with regard to the terminal member 60B1, one side (X1 side) thereof in the longitudinal direction (X direction) protrudes toward the inside of the connector hole 46B of the connector connecting unit 45B and achieves the function as the user terminal.

In addition, the other side (X2 side) in the longitudinal direction (X direction) of the terminal member 60B1 approaches up to the lower side of the core 20B and furthermore, is bent so as to be directed toward the lower side. It should be noted that the portion toward this lower side is the portion which corresponds to the lower-side protruding portion 72A of the user terminal 70A in the first exemplified embodiment mentioned above and this is referred to as a lower-side protruding portion 62B.

In addition, the portion which is continuous with this lower-side protruding portion 62B and goes along the longitudinal direction (X direction) is referred to as a connection terminal portion 61B. The connection terminal portion 61B is provided with the function of the connection terminal portion 71A of the user terminal 70A in the first exemplified embodiment mentioned above. Therefore, the connection terminal portion 61B is formed to be a portion which is plugged-in into the terminal hole 42B of the flange unit 40B.

In addition, the terminal member 60B2 is a portion which corresponds to the connection terminal portion 71A of the user terminal 70A in the first exemplified embodiment mentioned above. Therefore, the terminal member 60B2 is plugged-in into terminal hole 42B of the flange unit 40B.

In addition, with regard to the terminal member 60B3, the outward appearance thereof is provided in a substantially L-shape similarly as those of the connection terminal 60A and the user terminal 70A in the first exemplified embodiment mentioned above. However, the arrangement thereof is a little bit different from that of the connection terminal 60A and the user terminal 70A in the first exemplified embodiment mentioned above. Specifically, on the upper side of the terminal member 60B3, there is provided a portion which corresponds to the connection terminal 60A in the chip-support-piece portion 62A of the first exemplified embodiment mentioned above. In the explanation hereinafter, this portion is referred to as a chip-support-piece portion 63B. In addition, for the terminal member 60B3, there is provided a portion which corresponds to the lower-side protruding portion 72A of the user terminal 70A in the first exemplified embodiment mentioned above. In the explanation hereinafter, this portion is referred to as a lower-side protruding portion 64B.

Here, while the peripheral wall unit 37B is adjacent to the opening portion 36B on the other side (X2 side) in the longitudinal direction (X direction), there is provided a through-hole 39B so as to penetrate this peripheral wall unit 37B in the longitudinal direction (X direction). Into this through-hole 39B, there is plugged-in the chip-support-piece portion 63B mentioned above. Therefore, one side (X1 side) of the chip-support-piece portion 63B protrudes toward the opening portion 36B, in which the terminal member 60B2 is disposed such that a clearance gap will exist as much as necessary for the electrical connection of the capacitor 80B.

It should be noted that a dropout preventing portion 65B is provided for each of the three terminal members 60B1, 60B2 and 60B3. This dropout preventing portion 65B is a portion which is provided to be wider than the other portions in each of the terminal member 60B1, 60B2 or 60B3 and is inclined so as to become narrower along with the distance going toward one side (X1 side) from the other side (X2 side) in the longitudinal direction (X direction). Therefore, when the terminal members 60B1 and 60B2 are plugged-in into the terminal holes 42B, it becomes difficult for them to drop out toward the other side (X2 side). In addition, also in a case in which the terminal member 60B3 is plugged-in into the through-hole 39B, similarly, it becomes difficult for the terminal member 60B3 to drop out toward the other side (X2 side).

<With Regard to Manufacturing Method of Antenna Device 10B>

In case of manufacturing the antenna device 10B having a constitution as described above, the antenna device is formed similarly as the above-mentioned first exemplified embodiment, in which on an occasion of the injection-molding of the base 30B, it is allowed to employ a procedure in which an insert-molding is carried out by disposing the terminal members 60B at predetermined positions in the inside of the mold. In case of carrying out the insert-molding, a terminal base material 600B in the stage before forming the terminal member 60B2 and the terminal member 60B3 is disposed at a predetermined position in the inside of the mold. The terminal base material 600B is a portion for forming the terminal member 60B2 and the terminal member 60B3 by cutting-out them later.

Figure 10:
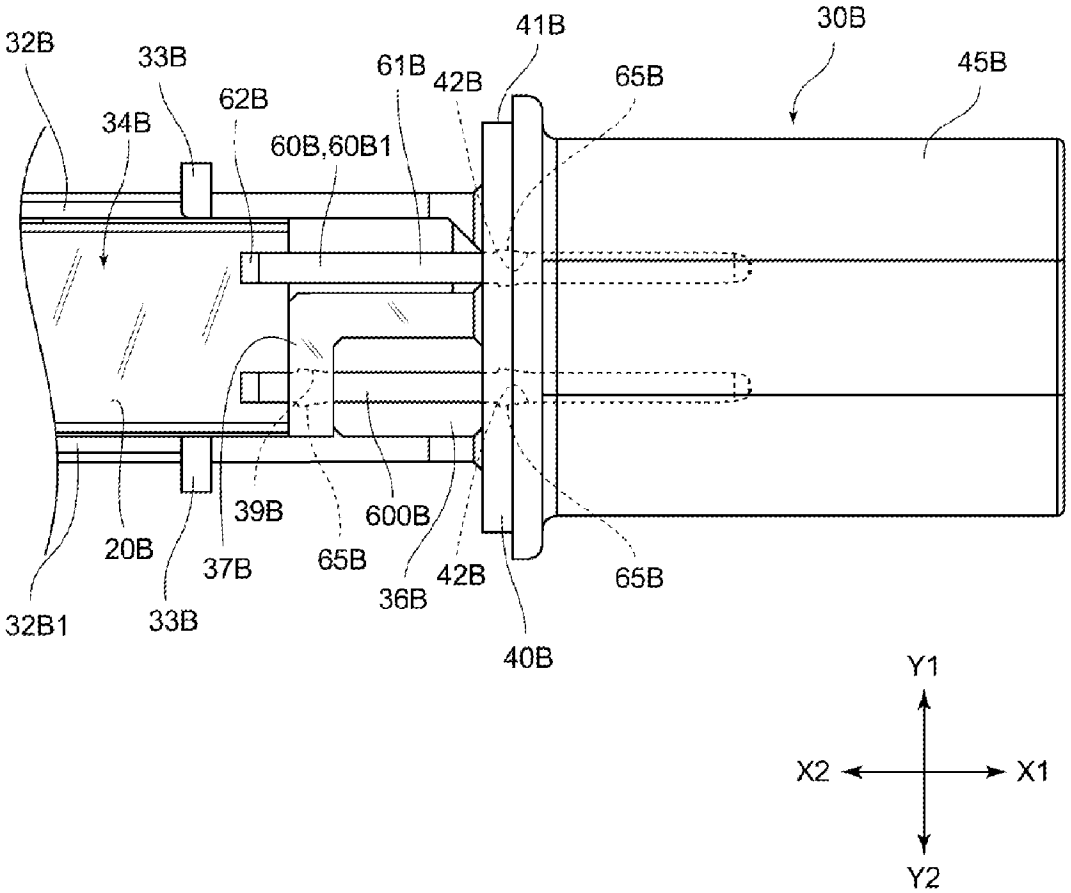
FIG. 10 is a plan view showing a state in which the terminal members and a terminal base material are arranged in the antenna device in FIG. 6.

In addition, in a case of not carrying out the insert-molding, there will be employed a procedure in which the base 30B is formed and thereafter, the terminal member 60B1 is plugged-in into the terminal hole 42B and further, the terminal base material 600B mentioned above is plugged-in into the terminal hole 42B and the through-hole 39B. It should be noted that FIG. 10 is a plan view showing a state in which a terminal member 60B1 and a terminal base material 600B are arranged.

Thereafter, the predetermined position of the terminal base material 600B is punched out (cut out: corresponding to cutting process). On an occasion of this punching-out, it is allowed to use a jig or the like appropriately for sandwiching the terminal base material 600B. When punching-out the terminal base material 600B in this manner mentioned above, the terminal member 60B2 and the terminal member 60B3 are formed.

In addition, after the punching-out of the terminal base material 600B, the capacitor 80B is mounted thereon (this process corresponds to the electronic component attachment process). At that time, the terminal member 60B2 and the terminal member 60B3 are coated with the cream solder and thereafter, the capacitor 80B is mounted such that the capacitor 80B bridges over the terminal member 60B2 and the terminal member 60B3. Thereafter, it is possible to utilize such a method of heating only the vicinity of that coated portion. However, it is allowed to mount the capacitor 80B, for example, by a method of laser welding, etc.

In addition, before or after the mounting of the capacitor 80B, the core 20B is mounted on the core insertion portion 34B and after that mounting, the conductive wire 51 is wound around the winding-frame unit 32B and caused by the winding force of the conductive wire 51, the side wall portion 32B1 of the opened bobbin unit 31B and the flange portion 32B2 are tighten, and the coil 50B is formed so as to fix the core 20B. Then, after the formation of the coil 50B, one terminal of the conductive wire 51 is bound onto the lower-side protruding portion 62B of the terminal member 60B1. In addition, the other terminal of the conductive wire 51 is bound onto the lower-side protruding portion 64B of the terminal member 60B3. After those bindings, the binding portions mentioned above are fixed, for example, by a soldering depending on a dip method or the like.

It should be noted that in case of mounting the capacitor 80B before binding the both terminals of the conductive wire 51 to the lower-side protruding portions 62B, 64B respectively, there is such a merit that it is difficult for the terminal members 60B1, 60B3 to drop out and in addition, that it is difficult for the positional deviation of the mounting position of the capacitor 80B to occur in a case in which the binding operation is carried out while applying tensions to the terminals. In addition, in case of binding the both terminals of the conductive wire 51 onto the lower-side protruding portions 62B, 64B respectively before mounting the capacitor 80B, there is such a merit that the soldering of the capacitor 80B can be carried out by utilizing the heat on an occasion of soldering the both terminals of the conductive wire 51, or the like.

It should be noted, as mentioned above, that the case (not shown) is fitted with and bonded onto the step portion 41B. In this manner, the antenna device 10B is formed.

<With Regard TO Effect>

Also in the antenna device 10B having the constitution as described above, similarly as the antenna device 10A in the first exemplified embodiment mentioned above, the terminal member 60B (terminal member 60B1) is pushed into the through-hole 39B and concurrently, the terminal base material 600B is pushed into the through-hole 39B and the terminal hole 42B. Thus, it becomes possible to mount the terminal member 60B and the terminal base material 600B on the terminal attachment unit 35B. Therefore, it becomes needless to use a mold for carrying out the insert-molding and it is possible to simplify the processing flow. In addition, it becomes needless to employ an insert-molding and therefore, it becomes possible to reduce the cost.

In addition, in this exemplified embodiment, the terminal attachment unit 35B is provided with the opening portion 36B which penetrates this terminal attachment unit 35B. In addition, for the opening portion 36B, at least two terminal members 60B (terminal member 60B2 and terminal member 60B3) approach in a state of being spaced apart from each other. Then, the capacitor 80B is arranged at the opening portion 36B, in which this capacitor 80B is mounted on the terminal members 60B2, 60B3 in a state of being electrically conductive. For this reason, it is possible to mount the capacitor 80B on the terminal members 60B2, 60B3 by coating cream solder on the terminal members 60B2, 60B3 and by applying hot air or the like thereto after installing the capacitor 80B on those portions. Therefore, it is possible to simplify the mounting of the capacitor 80B and it is possible to improve the productivity and the workability.

In addition, in this exemplified embodiment, the terminal base material 600B approaches the opening portion 36B and there are formed the two terminal members 60B2, 60B3 which are apart from each other by cutting off that terminal base material 600B. Therefore, it becomes unnecessary to insert the terminal member 60B2 and the terminal member 60B3 into the terminal holes 42B and the through-holes 39B one by one, and therefore, it is possible to reduce the complex processes.

(Third Exemplified Embodiment)

Next, there will be explained an antenna device 10C relating to a third exemplified embodiment of the present invention with reference to the drawings. It should be noted in this exemplified embodiment that although there will be omitted the explanation with regard to the common constitutions with those of the antenna device 10A in the first exemplified embodiment mentioned above, it is assumed that Alphabet "C" will be put at the ends of the reference numerals thereof instead of Alphabet "A" relating to the corresponding elements in the first exemplified embodiment. It should be noted that the Alphabet "C" means a constitution relating to the third exemplified embodiment. Therefore, although there will be eliminated the explanations or the like in the third exemplified embodiment, it is assumed, also with regard to similar constitutions as those of the antenna device 10A in the first exemplified embodiment, that there is a case in which the explanation will be carried out by putting the Alphabet "C".

Figure 11:
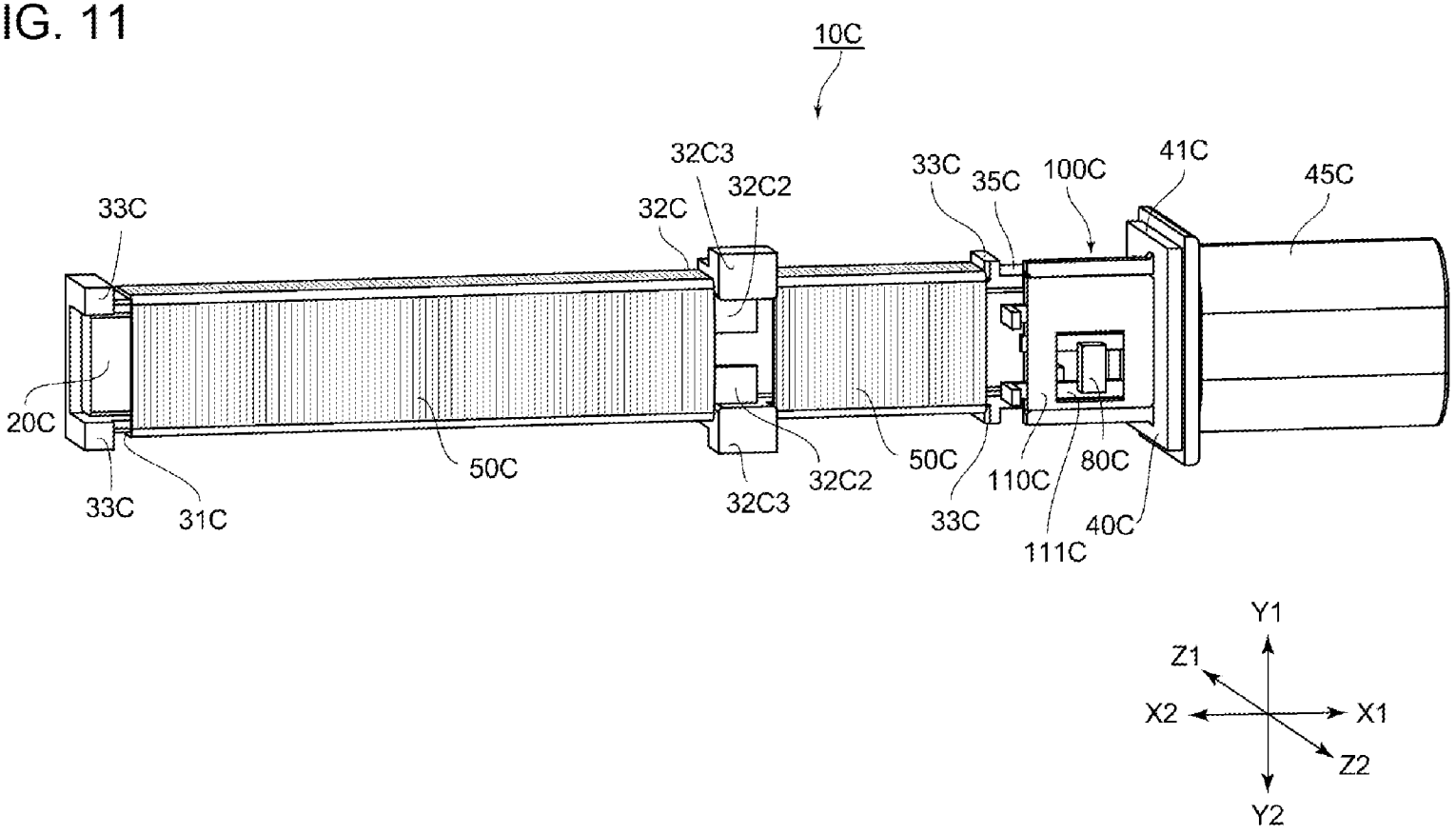
FIG. 11 is a perspective view showing a constitution of an antenna device relating to a third exemplified embodiment of the present invention and is a view showing a state seen from the lower surface side thereof.
Figure 12:
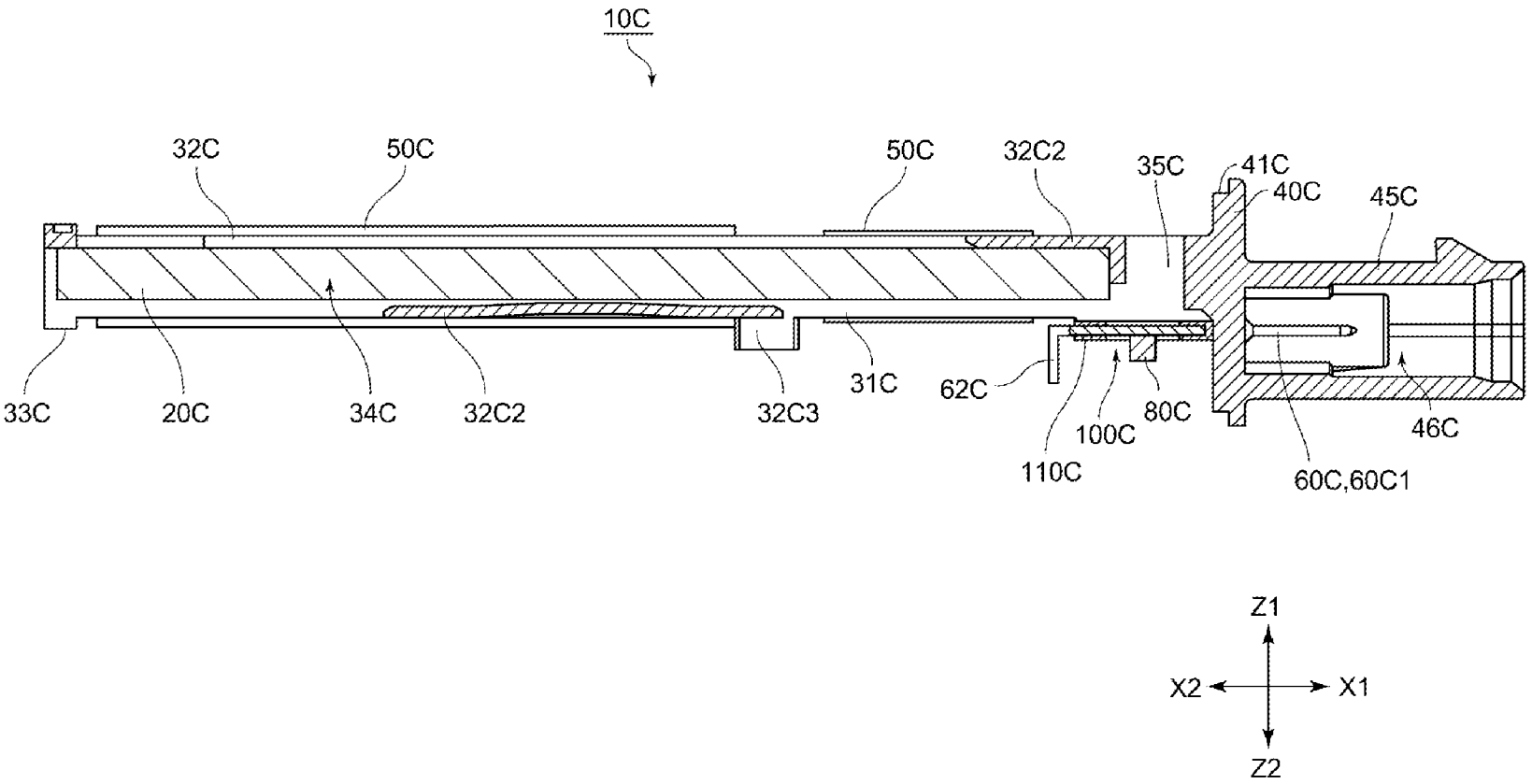
FIG. 12 is a cross-sectional side view showing a constitution of the antenna device in FIG. 11.
Figure 13:
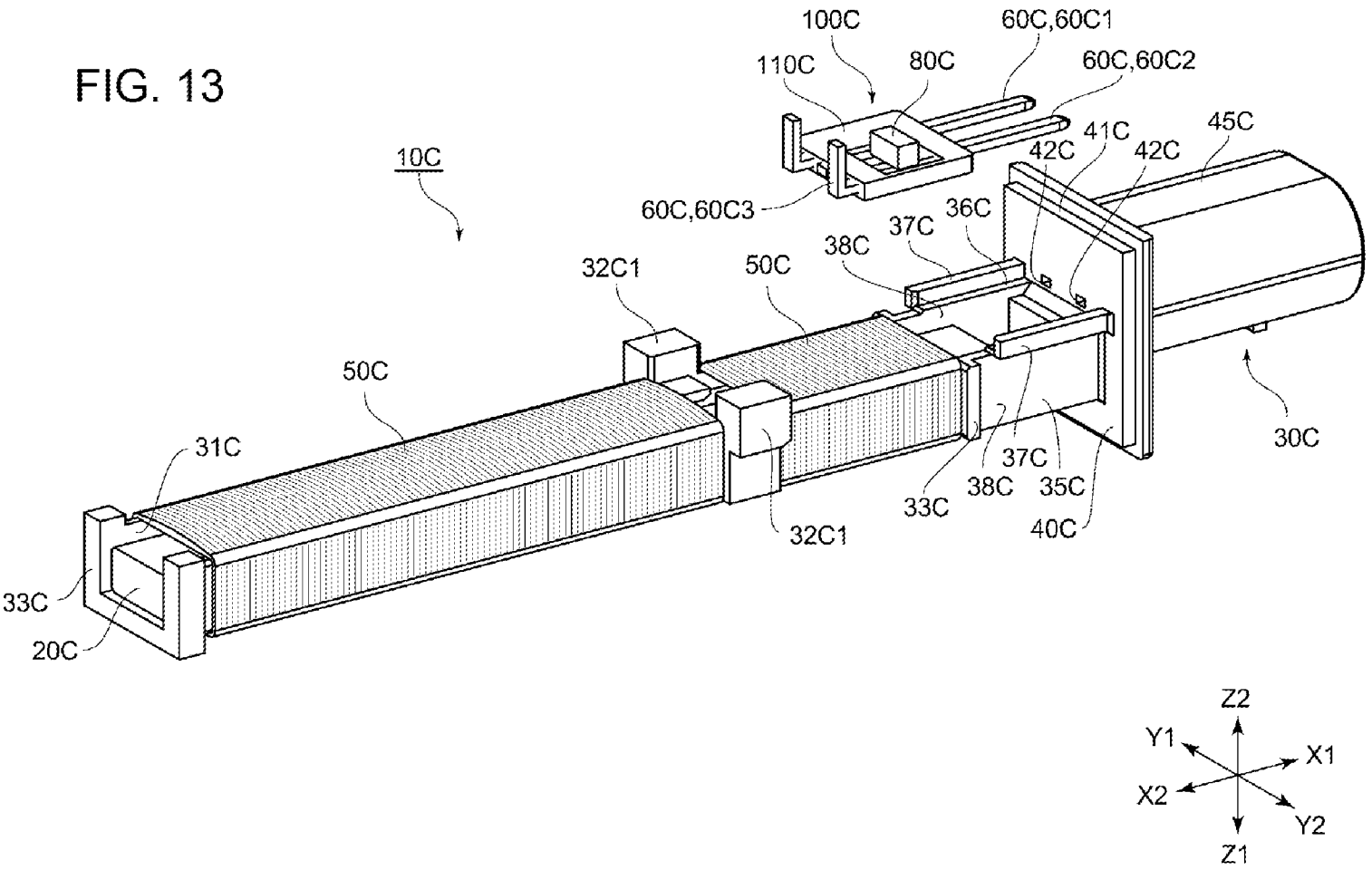
FIG. 13 is a perspective view showing a state in which an integrated terminal unit is removed from the terminal attachment unit in the antenna device in FIG. 11.

FIG. 11 is a perspective view showing a constitution of An antenna device 10C relating to a third exemplified embodiment and is a view showing a state of seeing from the lower surface side (Z2 side) thereof. FIG. 12 is a cross-sectional side view showing a constitution of the antenna device 10C. FIG. 13 is a perspective view showing a state in which an integrated terminal unit 100C is removed from the terminal attachment unit 35C.

As shown in FIGS. 11 to 13, in this exemplified embodiment, the integrated terminal unit 100C is mounted on the terminal attachment unit 35C. In order to mount this integrated terminal unit 100C, the terminal attachment unit 35C includes plate placing portions 36C and flange portions 37C. The plate placing portions 36C are formed as lower surface portions of extended portions 38C. More specifically, on one end sides (X1 sides) of the side wall portions 32C1 which constitute the winding-frame unit 32C, there are continuously provided the extended portions 38C each of which has a similar shape as that of this side wall portion 32C1. The lower surface portions of those extended portions 38C are the plate placing portions 36C which are the portions at which the integrated terminal unit 100C is placed. In the constitution shown in FIG. 13, these plate placing portions 36C are provided so as to protrude a little bit toward the lower side from the lower surface of the side wall portion 32C1. However, it is allowed for the plate placing portions 36C to protrude up to the height nearly equal to that of the side wall portion 32C1 or to be recessed from the side wall portion 32C1 without protruding therefrom.

In addition, the flange portions 37C are the portions which protrude so as to be directed from the outside edge portions of the plate placing portions 36C toward the lower sides (Z2 sides) thereof. The flange portions 37C are provided at the respective plate placing portions 36C. Here, the distance between the pair of flange portions 37C is provided a little bit narrower than the width (the size in the Y direction) of the integrated terminal unit 100C. For that reason, in case of mounting the integrated terminal unit 100C, the integrated terminal unit is to be pressed (press-fitted) by a strong pressure so as to widen the distance of the pair of flange portions 37C. Then, the integrated terminal unit 100C is mounted by a mechanism in which the integrated terminal unit 100C is sandwiched strongly caused by the elastic restoring-force of the pair of flange portions 37C (the plate placing portions 36C).

Figure 14:
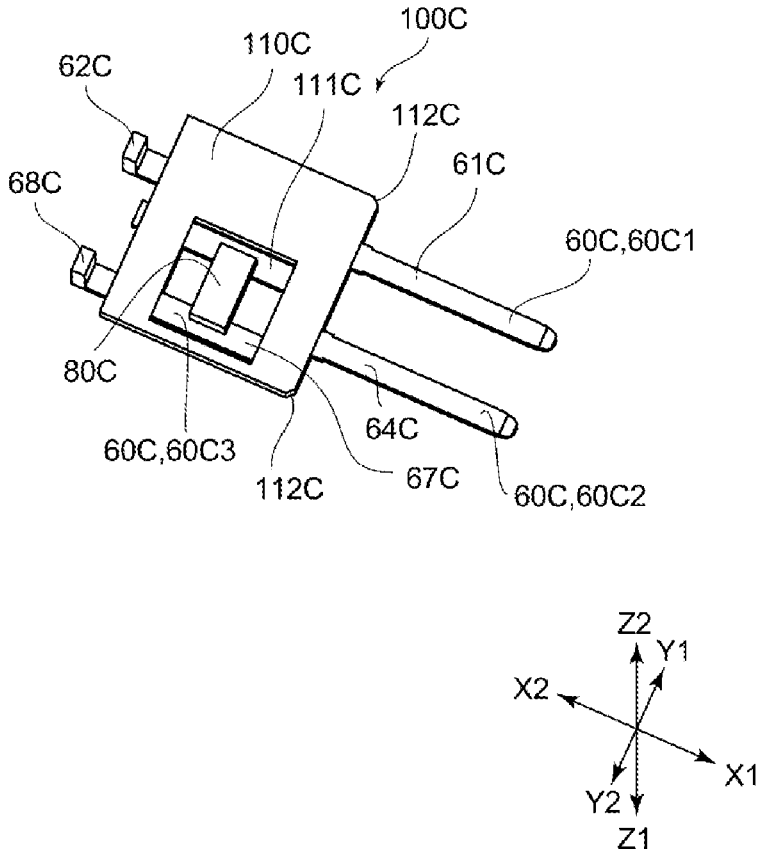
FIG. 14 is a perspective view showing a constitution of the integrated terminal unit of the antenna device in FIG. 11.
Figure 15:
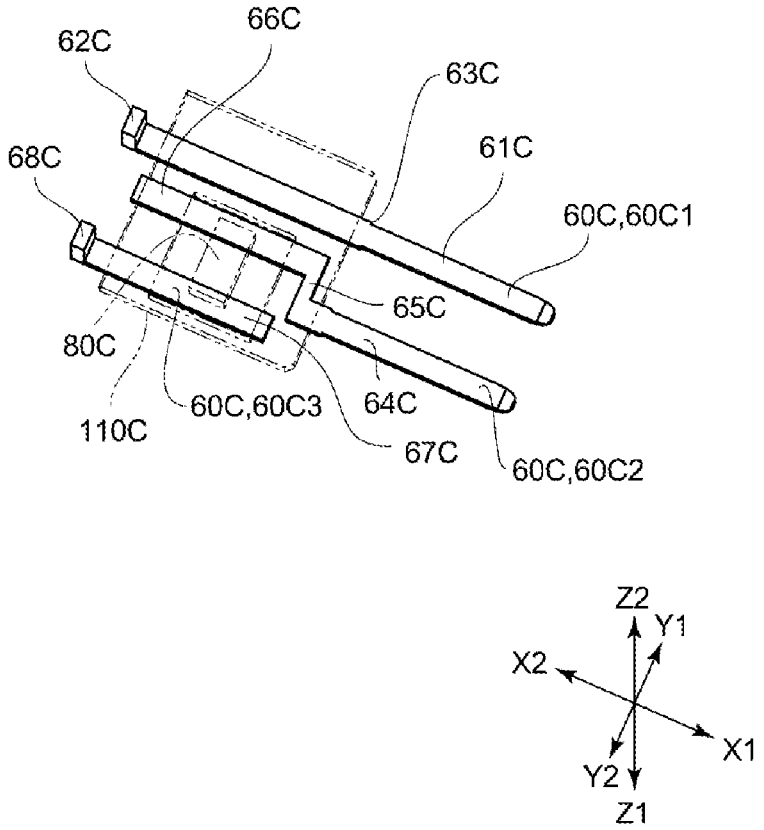
FIG. 15 is a perspective view showing a constitution of the terminal member of the antenna device in FIG. 11 and is a view showing an attachment plate transparently.

The integrated terminal unit 100C is mounted with respect to the terminal attachment unit 35C having such a constitution. FIG. 14 is a perspective view showing a constitution of the integrated terminal unit 100C. FIG. 15 is a perspective view showing a constitution of the terminal member 60C and is a view showing an attachment plate 110C transparently. As shown in FIG. 14, the integrated terminal unit 100C includes an attachment plate 110C, a plurality of terminal members 60C (three members in FIG. 15) and a capacitor 80C.

The attachment plate 110C is a plate-shaped portion which is formed by an injection-molding of a resin. It is preferable for the resin constituting this attachment plate 110C to be a heat-resistant resin which can endure the heating in the reflow furnace. For this resin, it is possible to cite various kinds of heat-resistant resins such as, for example, PTFE (Polytetrafluoroethylene), PPS (Polyphenylenesulfide), polyamide-imide, an acrylic resin, polyphenylene sulfide and the like, but it is allowed to use a heat-resistant resin other than those above.

This attachment plate 110C is a portion on which three of the terminal members 60C are mounted integrally. Therefore, the thickness of the attachment plate 110C is provided to be thicker than the thickness of the terminal member 60C. However, if it is possible to mount three of the terminal members 60C integrally, it is allowed for the thickness of the attachment plate 110C to be nearly equal to that of the terminal member 60C or to be thinner than that of the terminal member 60C.

This attachment plate 110C is provided with an opening portion 111C. Similarly as the opening portion 36B mentioned above, the opening portion 111C is a portion for arranging the capacitor 80C. Therefore, the area of the opening portion 111C is provided to be slightly larger by one-size compared with the area of the capacitor 80C when viewed planarly.

In addition, within the attachment plate 110C, for the corner portions which are positioned on one side (X1 side) in the longitudinal direction (X direction) and also which are edge portions in the width direction (Y direction), there are provided guide portions 112C. The guide portions 112C are portions which become the guides in case of mounting the integrated terminal unit 100C onto the terminal attachment unit 35C by the press-fitting, in which they are formed by cutting-out the above-mentioned corner portions in chamfered shapes. It should be noted that it is allowed for the guide portion 112C to have a shape other than the chamfered shape if it is possible to achieve an excellent guide of the press-fitting of the integrated terminal unit 100C. It is possible to employ various kinds of shapes such as, for example, a linearly tapered shape, a curved shape and the like.

In addition, as shown in FIGS. 14 and 15, the attachment plate 110C is mounted with three terminal members 60C. Specifically, there are mounted terminal members 60C1, 60C2, 60C3 respectively on the attachment plate 110C. It should be noted in this exemplified embodiment that there is employed a configuration in which by carrying out an insert-molding for arranging the terminal members 60C1 to 60C3 inside the mold, a portion of each of the terminal members 60C1 to 60C3 is buried into the inside of the attachment plate 110C.

Within these members, the terminal member 60C1 is a terminal member 60C which is positioned on the front side (Y1 side) in the width direction (Y direction) and is provided in a straight shape as shown in FIG. 15. For this terminal member 60C1, there are provided a connection terminal portion 61C similar as the connection terminal portion 61B mentioned above and a lower-side protruding portion 62C similar as the lower-side protruding portion 62B mentioned above. In addition, the connection terminal portion 61C is provided with a stair portion 63C similar as the stair portion 73A of the user terminal 70A in the first exemplified embodiment mentioned above. It should be noted that similarly as the terminal member 60B1 in the second exemplified embodiment, the terminal member 60C1 is provided to be the longest within the three terminal members 60C and in addition, is used in common for both the functions of the connection terminal 60A and the user terminal 70A in the first exemplified embodiment.

In addition, as shown in FIGS. 14 and 15, the terminal member 60C2 corresponds functionally to the terminal member 60B2 in the second exemplified embodiment mentioned above. However, the concrete configuration of the terminal member 60C2 is different from that of the above-mentioned terminal member 60B2. In more detail, the outward appearance of the terminal member 60C2 is provided in a twice-bent crank shape. In addition, the terminal member 60C2 is provided with a connection terminal portion 64C, an orthogonal portion 65C and a chip-support-piece portion 66C.

Within these portions, the connection terminal portion 64C is provided on one side (X1 side) of the longitudinal direction (X direction) of the terminal member 60C2. The connection terminal portion 64C is plugged-in into the terminal hole 42C and protrudes toward the connector hole 46C. For that reason, when an external connector is plugged-in into the connector hole 46C, the connection terminal portion 64C is connected together with the connection terminal portion 61C with respect to the external connector. Thus, there is employed a configuration in which it is possible to conduct the electric current through the coil 50C and the capacitor 80C.

On the other hand, the orthogonal portion 65C is continuous with the connection terminal portion 64C in a state of being substantially perpendicular thereto. This orthogonal portion 65C is buried in the inside of the attachment plate 110C. In addition, the chip-support-piece portion 66C is extended toward the other side (X2 side) of the longitudinal direction (X direction) in a state of being substantially perpendicular to the orthogonal portion 65C. This chip-support-piece portion 66C, whose mid portion is exposed within the opening portion 111C, supports the front side (Y1 side) of the capacitor 80C.

In addition, the other side (X2 side) in the longitudinal direction (X direction) of the chip-support-piece portion 66C is buried in the inside of the attachment plate 110C. It should be noted in the constitution shown in FIG. 14 that the other end side (X2 side) is exposed for the sake of convenience or the like of the injection-molding in the mold, but it is allowed to employ an unexposed constitution. Owing to such a constitution, there is obtained a configuration in which the terminal member 60C2 has a structure of being supported from the both sides by sandwiching the opening portion 111C.

Here, owing to the configuration of providing the orthogonal portion 65C, although there is a limitation of the size of the integrated terminal unit 100C in the width direction (Y direction), it is made possible to realize a constitution in which the chip-support-piece portion 66C is positioned on the front side (Y1 side) of the opening portion 111C which is opened to have an adequate width while responding to the width of the external connector. However, in a case in which it is possible to secure an adequate width for the integrated terminal unit 100C, it is possible to employ a constitution in which the orthogonal portion 65C is not provided.

In addition, the terminal member 60C3 is positioned on the rear side (Y2 side) in the width direction (Y direction). This terminal member 60C3 includes a chip-support-piece portion 67C and a lower-side protruding portion 68C. The chip-support-piece portion 67C, whose mid portion is exposed within the opening portion 111C similarly as the above-mentioned chip-support-piece portion 66C, supports the rear side (Y2 side) of the capacitor 80C. In addition, the lower-side protruding portion 68C is a portion which protrudes toward the lower side (Z2 side) similarly as the lower-side protruding portion 62C mentioned above. It should be noted that the lower-side protruding portion 62C is bound with one side of the terminal of the conductive wire 51 which forms the coil 50C and is fixed by a soldering or the like after the binding thereof. In addition, the lower-side protruding portion 68C is bound with the other side of the terminal of the conductive wire 51 which forms the coil 50C and is fixed by a soldering or the like after the binding thereof. Thus, there is constituted an LC resonant circuit.

It should be noted that, as shown in FIG. 11, in this exemplified embodiment, the positioning convex portion 33C which is positioned on one end side (X1 side) of the winding-frame unit 32C protrudes so as to be directed from the side wall portion 32C1 toward the outside of the width direction (Y direction) differently from the positioning convex portion 33A in the first exemplified embodiment mentioned above. However, it is allowed for the positioning convex portion 33C to employ a similar constitution as that of the positioning convex portion 33A in the first exemplified embodiment mentioned above.

<With Regard to Manufacturing Method of Antenna Device 10C>

In case of manufacturing the antenna device 10C having such a constitution as described above, the integrated terminal unit 100C is formed separately from other portions. Specifically, the terminal members 60C are disposed at predetermined positions in the inside of the mold and thereafter, by injecting a resin into the inside of the mold, the integrated terminal unit 100C is formed. At that time, the attachment plate 110C of the integrated terminal unit 100C is formed by a resin having a heat-resistance which can endure the heating in the reflow furnace.

Thereafter, the terminal member 60B2 and the terminal member 60B3 which are positioned at the opening portion 111C are coated with the cream solder. Thereafter, the connecting portions of the capacitor 80C are mounted on the positions which are coated with the cream solder in a contact state. Thereafter, the integrated terminal unit 100C is supplied to the inside of the reflow furnace, the cream solder is melted, and after cooling the integrated terminal unit 100C, the capacitor 80C is to be mounted.

It should be noted that it is allowed for the capacitor 80C to be mounted by employing other methods without being limited by the reflow method in which the integrated terminal unit 100C is supplied to the reflow furnace. It is possible for other methods above to use, for example, a dip soldering method and the like.

In addition, the base 30C is not supplied to the reflow furnace, so that it is not necessary to form the base from a heat-resistant resin and caused by the aspect without the heat-resistance, the base is formed by a resin whose cost is cheaper than that of the attachment plate 110C. Then, after forming the base 30C, the integrated terminal unit 100C is mounted on the terminal attachment unit 35C.

At the time of this mounting, it is preferable for the integrated terminal unit 100C to be press-fitted between the pair of flange portions 37C, because it is possible to carry out the mounting easily. For this press-fitting, the guide portions 112C are pressed against the other end sides (X2 sides) within the pair of flange portions 37C and thereafter, the integrated terminal unit is to be pressed between the pair of flange portions 37C. At that time, the integrated terminal unit is pressed as far as the end portion of one side (X1 side) of the plate placing portion 36C such that the terminal member 60C1 and the terminal member 60C2 are to be inserted into the terminal holes 42C respectively. In this manner, it is possible to mount the integrated terminal unit 100C onto the terminal attachment unit 35C.

It should be noted that it is possible for the attachment method by which the integrated terminal unit 100C is mounted onto the terminal attachment unit 35C to employ various kinds of methods other than the press-fitting method. For example, it is allowed to employ a method in which by providing a claw-shaped locking portion for the terminal attachment unit 35C, the integrated terminal unit 100C is to be locked and fixed thereon. In addition, it is allowed to employ a configuration in which there is formed a concavity-shaped portion for fitting the rib shaped portion or the side surface of the attachment plate 110C into the terminal attachment unit 35C and, for example, by sliding the integrated terminal unit 100C from the other side (X2 side) toward one side (X1 side) in the longitudinal direction (X direction), the integrated terminal unit 100C is to be mounted onto the terminal attachment unit 35C. In addition, it is allowed for the integrated terminal unit 100C to be mounted onto the plate placing portion 36C by employing adhesion or the like.

In addition, the integrated terminal unit 100C is press-fitted and mounted between the pair of flange portions 37C and thereafter, the core 20C is inserted into the core insertion portion 34C. After that mounting, the coil 50C is formed by winding the conductive wire 51 around the winding-frame unit 32C. Then, after the formation of the coil 50C, one terminal of the conductive wire 51 is bound onto the lower-side protruding portion 62C of the terminal member 60C1. In addition, the other terminal of the conductive wire 51 is bound onto the lower-side protruding portion 68C of the terminal member 60C3. After those bindings, these binding portions are fixed, for example, by a soldering or the like depending on a dip method.

It should be noted, as mentioned above, that a case (not shown) is fitted with and bonded onto the step portion 41C. In this manner, the antenna device 10C is formed.

<With Regard to Effect>

Also for such an antenna device 10C having a constitution as described above, similarly as the antenna device 10A of the first exemplified embodiment and the antenna device 10B of the second exemplified embodiment which were mentioned above, the terminal members 60C (terminal members 60C1, 60C2) provided at the integrated terminal unit 100C are pushed into the through-holes 39C. Thus, it becomes possible to mount the terminal members 60C1, 60C2 on the terminal attachment unit 35C. Therefore, in case of forming the base 30C, it becomes needless to use a mold for carrying out the insert-molding and it is possible to simplify the structure of the mold. In addition, in case of forming the base 30C, it becomes needless to employ an insert-molding and therefore, it becomes possible to reduce the cost.

In addition, although an insert-molding is employed in case of forming the integrated terminal unit 100C, the attachment plate 110C of this integrated terminal unit 100C has a simple shape compared with the base 30C and therefore, it becomes a situation in which the structure of the inside of the mold does not become complex so much, and in addition, it is also possible to carry out the insert-molding easily.

In addition, in this exemplified embodiment, a configuration is employed in which at the terminal attachment unit 35C, there is arranged the integrated terminal unit 100C. Then, the integrated terminal unit 100C is provided with the attachment plate 110C and the plurality of terminal members 60C, in which these terminal members 60C are fixed in a state of being spaced apart from each other by the attachment plate 110C. In addition, the integrated terminal unit 100C is provided with the opening portion 111C and for this opening portion 111C, at least two terminal members 60C (terminal member 60C2 and terminal member 60C3) approach in a state of being spaced apart from each other. Then, the capacitor 80C is arranged at the opening portion 111C and at that time, the capacitor 80C is mounted in a state of being electrically conductive with the terminal members 60C2, 60C3.

By employing such a constitution, it is possible for the integrated terminal unit 100C to be formed separately from other portions of the antenna device 10C. Therefore, it is possible to form the base 30C which is provided separately from the integrated terminal unit 100C by using a resin which is not provided with an adequate heat-resistance. More specifically, in order to mount the capacitor 80C onto the terminal members 60C2, 60C3, it is enough if only the integrated terminal unit 100C is to be supplied into the reflow furnace in which it is not necessary to supply the base 30C into the reflow furnace. Therefore, it is not necessary to form the base 30C from a heat-resistant resin and for this reason, it is possible to form the base by using a resin whose cost is cheap and which is not provided with an adequate heat-resistance.

Further, in case of mounting the integrated terminal unit 100C onto the terminal attachment unit 35C by the press-fitting, it is possible to mount the unit without using an adhesive agent and therefore, it is not necessary to employ such a process like a coating of the adhesive agent or a drying of the adhesive agent and it is possible to simplify the mounting operation of the integrated terminal unit 100C. Therefore, it is possible to improve the productivity and the workability of the antenna device 10C.

<Modified Example>

As described above, one exemplified embodiment of the present invention was explained, but it is possible for the present invention to employ various kinds of modifications departing from that embodiment above. Hereinafter, there will be described this matter.

In the above-mentioned exemplified embodiment, the capacitor 80A, 80B or 80C was explained for the electronic component. However, the electronic component is not limited by the capacitor 80A, 80B or 80C. It is possible to use various kinds of electronic components such as, for example, a chip resistor, a chip diode and the like. In addition, the electronic component is not limited by a case in which only one electronic component is used, and it is allowed to use a plurality of same or different electronic components.

In addition, in the above-mentioned exemplified embodiment, the electronic component is assumed to be of a surface-mount type. However, the electronic component is not limited by the surface-mount type and it is allowed to employ another type such as, for example, a pin type.

In addition, in the above-mentioned exemplified embodiment, only one core is used within the cores 20A, 21B and 20C, but it is allowed to use a plurality of cores.

In addition, one aspect of a manufacturing method of an antenna device of the present invention has a feature in which there are included steps of: forming a coil by winding a conductive wire around the periphery of a core which is formed by a magnetic material; and mounting a plurality of terminal members, which are electrically connected with a terminal of the conductive wire or with an electronic component, onto a terminal attachment unit which is arranged on one end side of the core before or after the step of forming a coil, wherein between the terminal attachment unit and the connector connecting unit, there is provided a flange unit which partitions those units, at the flange unit, there is provided a terminal hole, and in the step of mounting terminal members, at least two or more members of the terminal members are plugged-in into the terminal hole and concurrently, are mounted on the terminal attachment unit in a state of protruding toward the connector hole.

Further, in addition to the above-mentioned invention, it is preferable for another aspect of a manufacturing method of an antenna device of the present invention to further employ a configuration in which the terminal attachment unit is provided with an opening portion which penetrates the aforesaid terminal attachment unit and concurrently, a terminal base material for forming the terminal member approaches the opening portion and concurrently, there is provided a step of cutting and forming two terminal members which are apart from each other by cutting off that terminal base material, and after the step of mounting the terminal members, there is provided a step of mounting the electronic component in a state of being electrically conductive with the terminal members which approach the aforesaid opening portion.

Also, in addition to the above-mentioned invention, it is preferable for another aspect of a manufacturing method of an antenna device of the present invention to further employ a configuration in which at least one edge portion of the opening portion is provided with a peripheral wall unit which is formed to have a large thickness compared with other portions surrounding the aforesaid opening portion, and in the step of mounting the terminal member, the terminal member is mounted on the terminal attachment unit by penetrating either one of the terminal hole and the peripheral wall unit.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An antenna device comprising:

a core formed by a magnetic material;

a terminal attachment unit arranged on one end side of the core;

a coil which is arranged on the outer circumferential side of the core and concurrently, which is formed by winding a conductive wire;

a plurality of terminal members which are mounted on the terminal attachment unit and concurrently, each of which is electrically connected with a terminal of the conductive wire or an electronic component at any position thereof;

a connector connecting unit provided with a connector hole into which an external connector is inserted; and a partition unit which partitions the terminal attachment unit and the connector connecting unit, wherein there is provided a terminal hole at the partition unit, and at least two or more of the terminal members are plugged-in into the terminal hole and concurrently, are mounted in a state of protruding toward the connector hole, wherein, the terminal members are provided with a chip-support-piece portion and a plug-in piece portion which is bent with respect to the chip-support-piece portion, the terminal attachment unit is provided with a pair of terminal concave portions which make the distal side of the chip-support-piece portion protrude while making the pair of the terminal members enter thereinto, a pair of through-holes pass through the terminal attachment unit and the pair of through-holes are provided so as to be opened at arbitrary positions in the pair of the terminal concave portions and also, is provided such that the plug-in piece portion will be plugged-in thereinto, the side facing the through-hole within the terminal concave portions is provided in a cut-out opened shape, and at the protruding portion on the distal side of the chip-support-piece portion, there is mounted the electronic component in an electrically conductive state.

2. The antenna device according to claim 1, wherein the antenna device further comprises a case.

3. The antenna device according to claim 2, wherein the antenna device includes a base, the base is provided with a bobbin unit, the terminal attachment unit, a flange unit and the connector connecting unit, and the base is made of a thermoplastic resin or a thermosetting resin.

4. The antenna device according to claim 3, wherein the core is inserted into a core insertion portion of the base.

5. The antenna device according to claim 3, wherein the flange unit includes a step portion for fitting the case.

6. The antenna device according to claim 3, wherein the coil is wound on a winding-frame unit of the bobbin unit.

7. An antenna device comprising:

a core formed by a magnetic material;

a terminal attachment unit arranged on one end side of the core;

a coil which is arranged on the outer circumferential side of the core and concurrently, which is formed by winding a conductive wire;

a plurality of terminal members which are mounted on the terminal attachment unit and concurrently, each of which is electrically connected with a terminal of the conductive wire or an electronic component at any position thereof;

a connector connecting unit provided with a connector hole into which an external connector is inserted; and a partition unit which partitions the terminal attachment unit and the connector connecting unit, wherein there is provided a terminal hole at the partition unit, and at least two or more of the terminal members are plugged-in into the terminal hole and concurrently, are mounted in a state of protruding toward the connector hole, wherein the terminal attachment unit is provided with an opening portion which penetrates the terminal attachment unit and concurrently, for the opening portion, at least two of the terminal members approach in a state of being spaced apart from each other, at the opening portion, the electronic component is arranged and also, is mounted in a state of being electrically conductive with the terminal members which approach the opening portion.

8. The antenna device according to claim 7, wherein the antenna device further comprises a case.

9. The antenna device according to claim 8, wherein the antenna device includes a base, the base is provided with a bobbin unit, the terminal attachment unit, a flange unit and the connector connecting unit, and the base is made of a thermoplastic resin or a thermosetting resin.

10. The antenna device according to claim 9, wherein the core is inserted into a core insertion portion of the base.

11. The antenna device according to claim 9, wherein the flange unit includes a step portion for fitting the case.

12. The antenna device according to claim 9, wherein the coil is wound on a winding-frame unit of the bobbin unit.

13. The antenna device according to claim 7, wherein at least one edge portion of the opening portion is provided with a peripheral wall unit which is formed to have a large thickness compared with other portions surrounding the opening portion, and the terminal members are mounted on the terminal attachment unit by penetrating either one of the terminal hole and the peripheral wall unit.

14. An antenna device comprising:

a core formed by a magnetic material;

a terminal attachment unit arranged on one end side of the core;

a coil which is arranged on the outer circumferential side of the core and concurrently, which is formed by winding a conductive wire;

a plurality of terminal members which are mounted on the terminal attachment unit and concurrently, each of which is electrically connected with a terminal of the conductive wire or an electronic component at any position thereof;

a connector connecting unit provided with a connector hole into which an external connector is inserted; and a partition unit which partitions the terminal attachment unit and the connector connecting unit, wherein there is provided a terminal hole at the partition unit, and at least two or more of the terminal members are plugged-in into the terminal hole and concurrently, are mounted in a state of protruding toward the connector hole, wherein at the terminal attachment unit, there is arranged an integrated terminal unit, the integrated terminal unit is provided with an attachment plate and the plurality of the terminal members, the plurality of the terminal members are fixed in a state of being spaced apart from each other by the attachment plate, the integrated terminal unit is provided with an opening portion, for the opening portion, at least two of the terminal members approach in a state of being spaced apart from each other, at the opening portion, the electronic component is arranged and also, is mounted in a state of being electrically conductive with the terminal members which approach the opening portion.

15. The antenna device according to claim 14, wherein the antenna device further comprises a case.

16. The antenna device according to claim 15, wherein the antenna device includes a base, the base is provided with a bobbin unit, the terminal attachment unit, a flange unit and the connector connecting unit, and the base is made of a thermoplastic resin or a thermosetting resin.

17. The antenna device according to claim 16, wherein the core is inserted into a core insertion portion of the base.

18. The antenna device according to claim 16, wherein the flange unit includes a step portion for fitting the case.

19. The antenna device according to claim 16, wherein the coil is wound on a winding-frame unit of the bobbin unit.

* * * * *